US009669635B2

(12) United States Patent
Seino et al.

(10) Patent No.: US 9,669,635 B2
(45) Date of Patent: Jun. 6, 2017

(54) ATTACHMENT AND ATTACHMENT SYSTEM

(71) Applicant: SEIKO EPSON CORPORATION, Tokyo (JP)

(72) Inventors: Takeo Seino, Nagano (JP); Takahiro Naka, Nagano (JP); Satoshi Shinada, Nagano (JP); Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/610,146

(22) Filed: Jan. 30, 2015

(65) Prior Publication Data

US 2015/0145930 A1 May 28, 2015

Related U.S. Application Data

(63) Continuation of application No. 13/777,305, filed on Feb. 26, 2013, now Pat. No. 8,974,043, which is a (Continued)

(30) Foreign Application Priority Data

Mar. 24, 2004 (JP) ..... 2004-087251

(51) Int. Cl.
*B41J 2/175* (2006.01)
*B41J 2/315* (2006.01)

(52) U.S. Cl.
CPC ..... *B41J 2/315* (2013.01); *B41J 2/175* (2013.01); *B41J 2/17523* (2013.01); *B41J 2/17556* (2013.01)

(58) Field of Classification Search
CPC .... B41J 2/175; B41J 2/17523; B41J 2/17533; B41J 2/17556; B41J 2/17566
(Continued)

(56) References Cited

U.S. PATENT DOCUMENTS 5,367,328 A 11/1994 Erickson
5,751,319 A 5/1998 Robertson et al.
(Continued)

FOREIGN PATENT DOCUMENTS

CN 2355886 Y 12/1999
CN 1259088 A 7/2000
(Continued)

OTHER PUBLICATIONS

Japanese Office Action, dated Aug. 17, 2010, issued in Japanese Patent Appln. No. 2005-087019.
(Continued)

*Primary Examiner* — Anh T. N. Vo
(74) *Attorney, Agent, or Firm* — Stroock & Stroock & Lavan LLP

(57) ABSTRACT

An attachment is mountable on a carriage in place of a liquid container that contains liquid and that is mounted on the carriage having a liquid jet head for jetting liquid, so that the attachment can supply liquid introduced from outside to the liquid jet head. The attachment has a pressure control means provided in a flow passage which is formed in an attachment body and through which the liquid introduced from the outside is supplied to the liquid jet head.

2 Claims, 15 Drawing Sheets

Related U.S. Application Data continuation of application No. 12/763,165, filed on Apr. 19, 2010, now Pat. No. 8,403,459, which is a continuation of application No. 11/085,351, filed on Mar. 21, 2005, now abandoned.

(58) Field of Classification Search

USPC ..... 347/19, 49, 85

See application file for complete search history.

(56) References Cited

U.S. PATENT DOCUMENTS

| | | | | |
|---|---|---|---|---|
| 5,880,748 | A | 3/1999 | Childers et al. | |
| 5,912,688 | A | 6/1999 | Gragg | |
| 5,992,990 | A | 11/1999 | Childers et al. | |
| 6,010,210 | A * | 1/2000 | Wilson | B41J 2/17503 347/7 |
| 6,039,430 | A * | 3/2000 | Helterline | B41J 2/17509 347/19 |
| 6,084,617 | A | 7/2000 | Balazer | |
| 6,276,784 | B1 | 8/2001 | Ikkatai et al. | |
| 6,312,088 | B1 | 11/2001 | Seino | |
| 6,312,106 | B1 | 11/2001 | Walker | |
| 6,332,481 | B1 | 12/2001 | Shinada et al. | |
| 6,338,553 | B1 | 1/2002 | Lewis et al. | |
| 6,390,611 | B1 | 5/2002 | Kobayashi et al. | |
| 6,454,381 | B1 | 9/2002 | Olsen et al. | |
| 6,505,926 | B1 | 1/2003 | Trafton et al. | |
| 6,536,861 | B1 | 3/2003 | Usui et al. | |
| 6,536,886 | B1 | 3/2003 | Mott | |
| 6,585,359 | B1 | 7/2003 | Gasvoda et al. | |
| 6,692,119 | B2 | 2/2004 | Yu et al. | |
| 6,786,581 | B1 | 9/2004 | Shinada et al. | |
| 6,789,882 | B2 | 9/2004 | Hiramatsu et al. | |
| 6,799,843 | B2 | 10/2004 | Okamoto | |
| 6,886,927 | B2 | 5/2005 | Shinada et al. | |
| 6,899,417 | B1 | 5/2005 | Shinada et al. | |
| 7,008,051 | B2 | 3/2006 | Akermalm | |
| 7,090,341 | B1 | 8/2006 | Miyazawa | |
| 7,090,344 | B2 | 8/2006 | Shinada et al. | |
| 7,156,507 | B2 | 1/2007 | Aruga et al. | |
| 7,195,345 | B2 | 3/2007 | Shinada et al. | |
| 7,249,831 | B2 | 7/2007 | Childers et al. | |
| 7,278,718 | B2 | 10/2007 | Aruga et al. | |
| 7,780,277 | B2 | 8/2010 | Aruga et al. | |
| 2002/0167572 | A1 | 11/2002 | Heim et al. | |
| 2003/0132980 | A1 | 7/2003 | Yamazaki et al. | |
| 2003/0146958 | A1 | 8/2003 | Aruga et al. | |
| 2004/0021722 | A1 | 2/2004 | Steinmetz et al. | |

FOREIGN PATENT DOCUMENTS

| | | | |
|---|---|---|---|
| CN | 1261029 | A | 7/2000 |
| CN | 2536401 | Y | 2/2003 |
| CN | 1403284 | A | 3/2003 |
| EP | 0965451 | A2 | 12/1999 |
| EP | 1279515 | A2 | 1/2003 |
| EP | 1398156 | A2 | 3/2004 |
| EP | 1424202 | A1 | 6/2004 |
| EP | 1454754 | A1 | 9/2004 |
| JP | 05-050610 | A | 3/1993 |
| JP | 06-183018 | A | 7/1994 |
| JP | 08-174860 | A | 7/1996 |
| JP | 09-104117 | A | 4/1997 |
| JP | 2000-141687 | A | 5/2000 |
| JP | 2001-121715 | A | 5/2001 |
| JP | 2001-328279 | A | 11/2001 |
| JP | 2002-248794 | A | 9/2002 |
| JP | 2003-048315 | A | 2/2003 |
| JP | 2003-200586 | A | 7/2003 |
| JP | 2003-251825 | A | 9/2003 |
| JP | 2003-312000 | A | 11/2003 |
| JP | 2003-326732 | A | 11/2003 |
| JP | 2004-249511 | A | 9/2004 |
| TW | 538909 | | 6/2003 |
| TW | 579331 | | 3/2004 |
| TW | 200404034 | A | 3/2004 |
| TW | I276542 | B | 3/2007 |
| WO | 97/42035 | A1 | 11/1997 |
| WO | 03/041964 | A1 | 5/2003 |

OTHER PUBLICATIONS

Japanese Office Action, dated Jan. 4, 2011, issued in Japanese Patent Appln. No. 2005-087019.

Japanese Office Action, dated Apr. 12, 2011, issued in Japanese Patent Appln. No. 2005-087019.

Decision to Decline Amendment dated Apr. 12, 2011 in Japanese Patent Appln. No. 2005-087019.

* cited by examiner

ATTACHMENT AND ATTACHMENT SYSTEM

BACKGROUND OF THE INVENTION

The present invention relates to an attachment and a liquid supplying device.

An inkjet printer is widely known as a liquid jet device for jetting liquid to a target through a liquid jet head. The inkjet printer is composed of a carriage and a print head mounted on the carriage. While the carriage moves toward a printing medium as a target, ink is ejected from a nozzle formed in the print head, so that printing is performed on the printing medium.

Among these kinds of inkjet-type printing devices, one of them has such a configuration (so-called on-carriage type) that includes respective ink cartridges for supplying ink to a print head, which are mounted so as to be installed detachably on the carriage. However, ink capacity of the ink cartridge is limited in the on-carriage type of inkjet printing device. Therefore, ink cartridges need to be replaced frequently and a running cost increases, when a relatively large amount of printing is performed.

In order to solve such a problem, there is disclosed a following inkjet printer in Japanese Patent Laid-Open No. 2003-326732. In the inkjet printer disclosed in Japanese Patent Laid-open No. 2003-326732, printing is usually performed with respective ink cartridges mounted on a carriage. But, in the case where a large amount of printing is performed, attachments are mounted on a carriage to perform printing. In addition, ink is filled into the attachments mounted on the carriage from outer ink tanks through tubes and the ink is supplied to a print head due to a differential head.

However, the ink is supplied to the print head from the outer ink tank clue to a differential head in the inkjet printer, so that the supply pressure into the print head depends on the ink level within the outer ink tank. Accordingly, the weight of ink drops ejected from the print head is varied according to the ink level, so that a printing quality differs depending on the amount of ink remaining in the outer ink tank.

CN2355886 and CN2536401 disclose an automatic ink supplying device including an ink cartridge for supplying ink which is connected to a printer ink cartridge through an ink duct. Even in the automatic ink supplying devices disclosed in these Japanese Unexamined Utility Model Registration Application Publications, the ink in the ink cartridge for supplying ink provided outside the printer forms an integrated system having a constant successive pressure with the ink within the printer ink cartridge through the ink duct, so that the supply pressure into the print head depends on the ink level within the ink cartridge for supplying ink. Accordingly, there is a problem in that a printing quality is different according to the amount of ink remaining in the ink cartridge for supplying ink.

U.S. Pat. No. 5,731,319 (see Abstract) discloses a supply ink reservoir which is connected to a printing ink container of an ink cartridge through a tube device. While ink is ejected from a print head of a printing cartridge to print out a sheet, the supply ink reservoir can supply ink to the cartridge. An embodiment is disclosed in U.S. Pat. No. 5,731,319, which includes a supplement ink reservoir in which an ink container bottle is disposed in the upper portion of the supply ink reservoir. The supply ink reservoir is a part of the ink container bottle. According to the embodiment, the supplement ink reservoir and the supply ink reservoir communicate with each other through the path which is controlled by a floating valve mechanism disposed inside the supply ink reservoir. Although the liquid level of the supply ink reservoir can be controlled to be held in a substantially constant level by the floating valve mechanism, a space is required inside the supply ink reservoir so that the floating valve can operate. In addition, when the liquid level of the supply ink reservoir decreases so that the path is opened by the floating valve, the ink in the supplement ink reservoir reaches the fluid level (liquid level) of the supply ink reservoir through the space. Therefore, a minute pressure variation or pressure pulse acts on the ink to be supplied to the printing cartridge, which makes it possible to reduce a printing quality.

U.S. Pat. No. 5,367,328 (see lines 3 to 25 and lines 56 to 59 in the tenth column) discloses following embodiments. One embodiment uses a passive differential pressure in sending ink to an ink supply container from an ink reservoir container 14, in an integrated system without mechanical assistance from a pump or the like. Another embodiment is an active embodiment which delivers ink to an inkjet cartridge from an outer ink reservoir container through a mechanical pump or the like in place of the passive differential pressure. In addition, U.S. Pat. No. 5,367,328 discloses an embodiment which uses a capillary action of a form element in order to generate the differential pressure between an upper opening vent portion of the ink supply container which is connected to the ink reservoir container operatably and a lower portion close to a print head of the ink supply container, in which a bottom of the ink reservoir container has the substantially same level as that of the ink supply container. Since the pump or the like needs to be mounted and controlled in an active system, the entire system becomes complicated. When the form element is disposed in the ink supply container in a passive system, the ink flow within the form element needs to be optimal.

The present invention has been made to solve the above-mentioned problems. An advantage of the present invention is that it provides an attachment and a liquid supplying device capable of securing a constant weight of ejected liquid drops of a liquid jet head, regardless of the amount of liquid consumed in an outer liquid container.

SUMMARY OF THE INVENTION

In order to solve the above problems, an attachment of the present invention is mounted on a carriage so that the attachment can be replaced with a liquid container for containing liquid mounted on the carriage which includes a liquid jet head for jetting the liquid. The attachment supplies the liquid introduced from outside to the liquid jet head. In addition, the attachment is provided with a pressure control means in a flow passage where the liquid introduced from outside and disposed in the attachment body is supplied to the liquid jet head.

According to the present invention, the attachment is mounted on the carriage in place of the liquid container, so that liquid can be supplied to the liquid jet head from outside through the attachment. In addition, a pressure of liquid to be supplied to the liquid jet head from outside can be secured constantly by the pressure control means provided in the attachment. Accordingly, a liquid jet quality of the liquid jet head can be secured uniformly.

The attachment of the invention includes a first liquid supplying section, to which the liquid from outside is introduced, in the flow passage within the attachment body, a second liquid supplying section in which the liquid from the first liquid supplying section is flowed and through which the flowed liquid is supplied to the liquid jet head, and the pressure control means between the first liquid supplying section and the second liquid supplying section. The pressure control means is a valve device which causes the first liquid supplying section to communicate with the second liquid supplying section when a liquid pressure of the second liquid supplying section is equal to or lower than a predetermined reference pressure and also causes the first liquid supplying section not to communicate with the second liquid supplying section when a liquid pressure of the second liquid supplying section is higher than the predetermined reference pressure.

According to the present invention, if a liquid pressure in the side of the second liquid supplying section for supplying ink to the liquid jet head is equal to or lower than the predetermined reference pressure, the valve device cause the first liquid supplying section to communicate with the second liquid supplying section. The liquid of the first liquid supplying section flows in the second liquid supplying section to raise the liquid pressure of the second liquid supplying section. And, if the liquid pressure of the second liquid supplying section approaches the reference pressure, the valve device causes the first liquid supplying section not to communicate with the second supplying section. Accordingly, the liquid pressure of the second liquid supplying section is held near to the reference pressure. As a result, the weight of ink drops ejected from the liquid jet head is equally distributed so that a printing quality does not vary.

The attachment of the invention includes a first liquid supplying section, to which the liquid from outside is introduced, in the middle of the flow passage, a second liquid supplying section in which the liquid from the first liquid supplying section is flowed and through which the flowed liquid is supplied to the liquid jet head, and the pressure control means between the first liquid supplying section and the second liquid supplying section. The pressure control means is a valve device which causes the first liquid supplying section to communicate with the second liquid supplying section when the liquid differential pressure between the first liquid supplying section and the second liquid supplying section is equal to or higher than a predetermined reference pressure and also causes the first liquid supplying section not to communicate with the second liquid supplying section when the differential pressure is lower than the predetermined reference pressure.

According to the present invention, the valve device causes the first liquid supplying section to communicate with the second liquid supplying section when the differential pressure between the first liquid supplying section and the second liquid supplying section is equal to or higher than a reference pressure. The liquid of the first liquid supplying section flows in the second liquid supplying section to raise the liquid pressure of the second liquid supplying section. And, if the differential pressure is lower than the reference pressure, the valve device causes the first liquid supplying section not to communicate with the second liquid supplying section. Accordingly, the liquid pressure of the second liquid supplying section is held under a pressure which the liquid differential pressure between the second liquid supplying section and the first liquid supplying section is taken as a reference pressure. As a result, the weight of ink drops ejected from the liquid jet head is equally distributed so that a printing quality does not vary.

In the present invention, the pressure control means is a porous member inserted in the attachment.

According to the present invention, the pressure control means is a porous member inserted in the attachment, so that the liquid within an outer liquid container can be supplied to the liquid jet head at a constant pressure, for example, without changing complicated valve devices frequently. Accordingly, a printing quality does not vary.

In the attachment of the present invention, a communication hole is provided in a connection portion which is detachably connected to the liquid jet head provided in the attachment body, the communication hole communicating with the second liquid supplying section. The communication hole is provided with an opening and closing valve which is opened when connected to the carriage to supply the liquid of the second liquid supplying section to the liquid jet head.

According to the present invention, since an opening and closing valve is Provided in the connection portion which connects the opening and closing valve to the carriage, the liquid within the attachment body does not leak from the connection portion, for example, when the attachment is removed from the carriage.

In the attachment of the present invention, the attachment body includes a storage means which stores liquid information.

According to the present invention, even when liquid is supplied to the liquid jet head from the outside through the attachment, the consumed amount of liquid supplied from the outside or the remained amount of liquid to be supplied from the outside can be stored, which makes it possible to perform a normal liquid jetting operation.

A liquid supplying device of the present invention, which supplies liquid to a carriage including a liquid jet head for jetting the liquid, is composed of the above-described attachment, an outer liquid container which is provided in a position away from the attachment and contains liquid to be jetted from the liquid jet head, and a tube which connects the outer liquid container to the attachment to supply liquid of the outer liquid container to the attachment.

According to the present invention, the attachment is connected to the carriage, in place of the liquid container which is directly mounted on the carriage. And, the outer liquid container is connected to the attachment through the tube. Accordingly, the liquid of the outer liquid container is supplied to the attachment through the tube. The liquid supplied to the attachment is pressure-controlled to be supplied to the liquid jet head. As a result, liquid can be continuously jetted for a long time without an excessive load with respect to the carriage and further, can be jetted while a liquid jet quality is constantly maintained, even when an outer liquid container, which contains a large amount of liquid, is used.

The present disclosure relates to the subject matter contained in Japanese patent application No. 2004-087251 (filed on Mar. 24, 2004), which is expressly incorporated herein by reference in its entirety.

DESCRIPTION OF THE PREFERRED EMBODIMENT

First Embodiment

Figure 1:
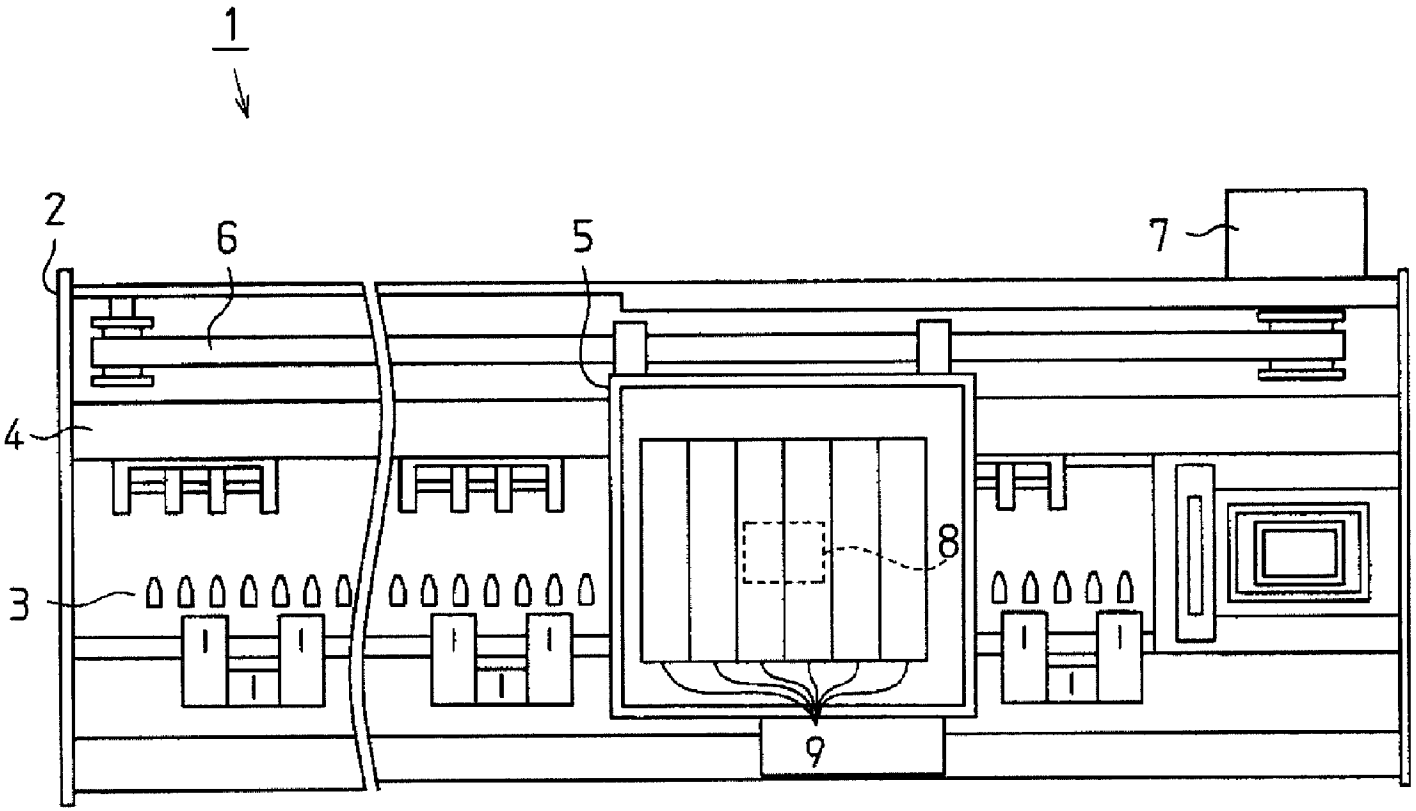
FIG. 1 is a plan view of a printer on which ink cartridges are mounted in a first embodiment.

Hereinafter, a first embodiment of the present invention will be described with reference to FIGS. 1 to 9. FIG. 1 is a plan view of an inkjet-type recording device (hereinafter, referred to as a printer 1) as a liquid jet device of the present embodiment.

The printer 1 includes a frame 2 as shown in FIG. 1. Platens 3 are installed in the frame 2, on which papers are fed by a paper feeding mechanism (not shown). A guide member 4 is installed parallel to the platens 3 in the frame 2. A carriage 5 is inserted and supported movably in an axis direction of the guide member 4 thereon. Further, the carriage 5 is driven by and connected to a carriage motor 7 through a timing belt 6. Therefore, driving the carriage motor 7 makes the carriage 5 travel back and forth along the guide member 4.

Figure 2:
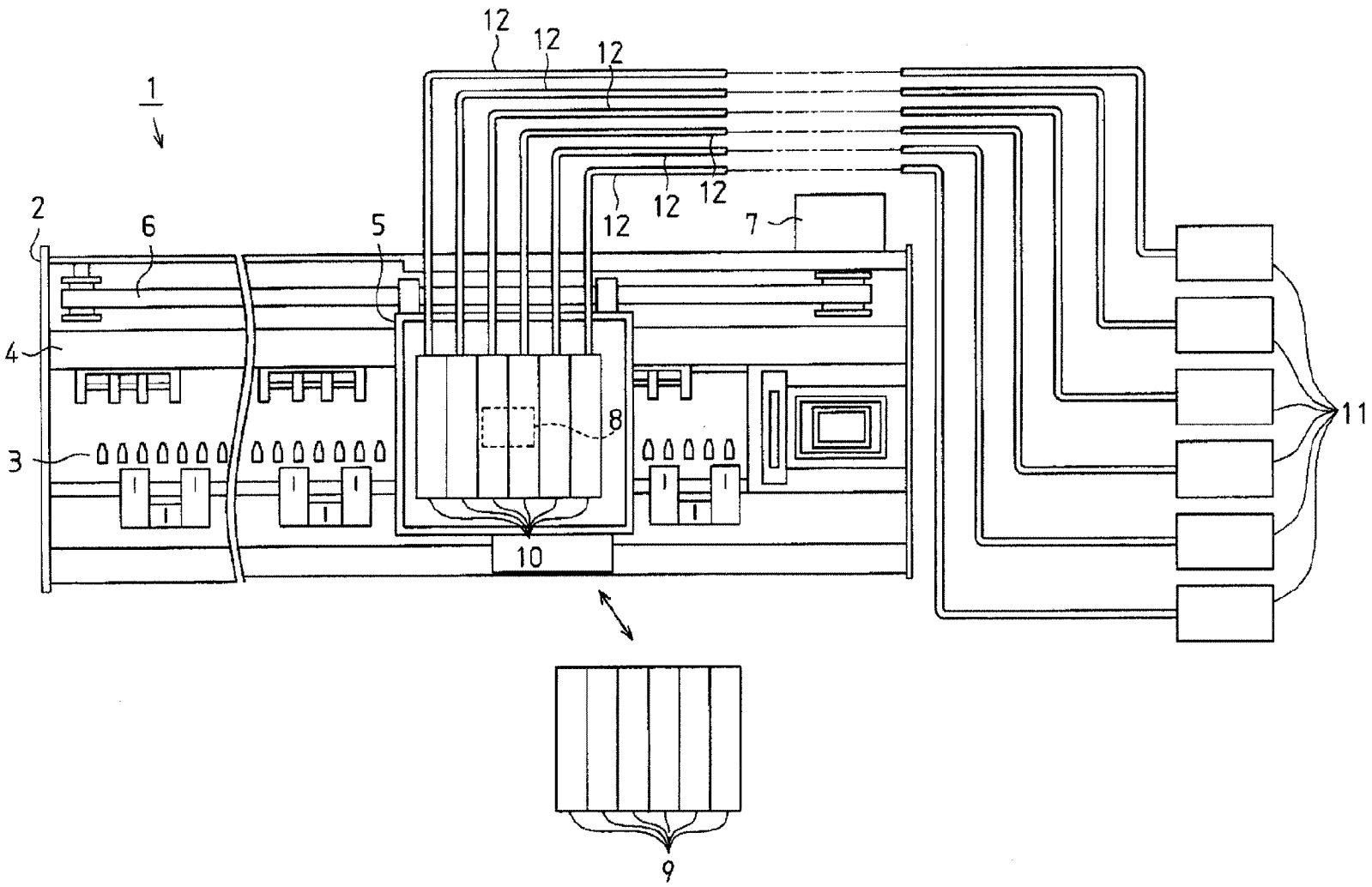
FIG. 2 is a plan view of the printer on which attachments are mounted in the first embodiment.

A print head 8 as a liquid jet head is mounted on a surface of the carriage 5 opposite to the platens 3. Six ink cartridges 9 as liquid containers are mounted on the carriage 5, which supplies ink as liquid to the print head 8. The ink cartridges 9 are detachable on the carriage 5, so that six attachments 10 in place of the ink cartridges 9 can be mounted detachably as shown in FIG. 2. When the attachments 10 are mounted on the carriage 5, the printer 1 functions as so-called off-carriage-type printer which receives ink from outside, unlike when the ink cartridges 9 are mounted. Six of the ink cartridges 9 and six of the attachments 10 are prepared for the printer 1, respectively, corresponding to colors (types) of ink used in the printer 1. Further, the attachments 10 are compatible with the ink cartridges 9 on the mounted shape with respect to the print head 8 provided in the carriage 5 and can be mounted detachably on the carriage 5 in place of the ink cartridges 9. Details on the attachments 10 will be described later. A nozzle ejecting port (not shown) is provided on the bottom surface of the print head 8, from which ink drops are ejected on a piece of paper.

When the attachments 10 are mounted on the carriage 5 as shown in FIG. 2, six outer ink tanks 11 as outer liquid containers are provided outside the printer 1, which have larger volume than the ink cartridges 9. The outer ink tanks 11 contain various types of ink larger than that of the ink cartridges 9 and are respectively connected to the attachments 10 through flexible ink supply tubes 12. When the attachments 10 are mounted on the carriage 5, these outer ink tanks 11 supply various colors of ink to the respective attachments 10 and then, the ink is supplied to the printer head 8. Further, the liquid supplying device in the present embodiment is composed of the attachments 10, the outer ink tanks 11, and ink supply tubes 12.

In EP1454754, each of the outer ink tanks 11 can use a structure of an ink pack 25, which is composed of a bag portion 36 and an outlet portion 37, or a structure of an ink pack 121, which is composed of a box body 122 and a film member 123 which sealingly closes the opening of the box body 122. These structures of ink packs are disposed outside the printer 1 so that they have an ink capacity three to ten times larger than the ink cartridge 9 has. The ink supply tube is connected to the outlet portion 37 or a cylindrical body 126, so that the ink pack can be used as the outer ink tank 11. The structure of the ink pack (25, 121) is discussed in detail in EP1454754, the disclosure of which is incorporated herein by reference in its entity.

In addition, each of the outer ink tanks 11 can use a structure disclosed in JP2004.249511, in which the outer ink tank is used as the ink cartridge 9 which accommodates an ink pack including a plurality of ink containing chambers in a case. In other words, the ink supply tube 12 is connected to a stopper 21 of the ink cartridge 9 in JP2004-249511 to cause the attachment 10 to communicate with the ink packs (11, 12, 13, and 14), so that the ink cartridge 9 can be used as the outer ink tank 11 of the present invention. When the ink cartridge 9 is used as the outer ink tank 11 of the present invention, it is preferable that the most downstream ink containing chamber can be accommodated with the ink pack folded in a case so as to be the lower side in a direction of gravitational force from the upstream ink chamber. Accordingly, a stopper insertion portion 35 supporting the stopper 21 may be formed in the bottom side of the case. Further, a pressured air is introduced into the ink cartridge 9 through an air introducing portion 37 in JP2004-249511. However, when the ink cartridge 9 is disposed in an appropriately high position with respect to the print head 8 in the outside of the printer 1 in the case where the ink cartridge 9 is used as the outer ink tank 11 of the present invention, ink can be supplied from the ink cartridge 9 to the attachment 10 through the ink supply tube 12, only if the inside of the ink cartridge 9 communicates with air through the air introducing portion 37 without the introduction of the pressured air. The ink cartridge 9 is discussed in detail in JP2004-249511, the disclosure of which is incorporated herein by reference in its entity.

Next, the attachments 10 will be described with reference to FIGS. 3 to 8.

Figure 3:
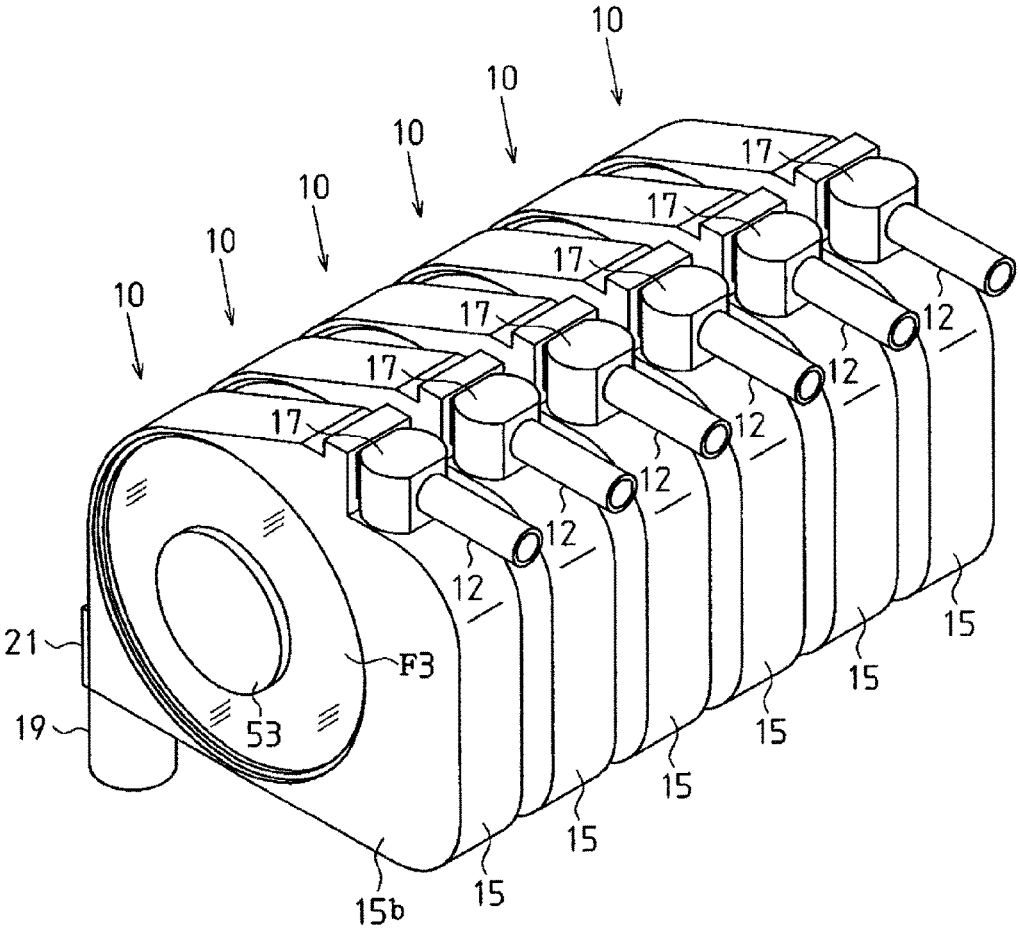
FIG. 3 is a perspective view of the attachments in the first embodiment.

FIG. 3 is a perspective view of the attachments 10 corresponding to respective colors of ink. The attachments 10 may be used separately, respectively, but their operationalities are improved when they are used together, as shown in FIG. 3. Further, the respective attachments 10 for cyan ink, magenta ink, yellow ink, light cyan ink, and light magenta ink have the same configuration as the attachment 10 for black ink has. Therefore, hereinafter, only the attachment 10 for black ink will be described and a description of the attachments 10 for other colors will be omitted.

Figure 4:
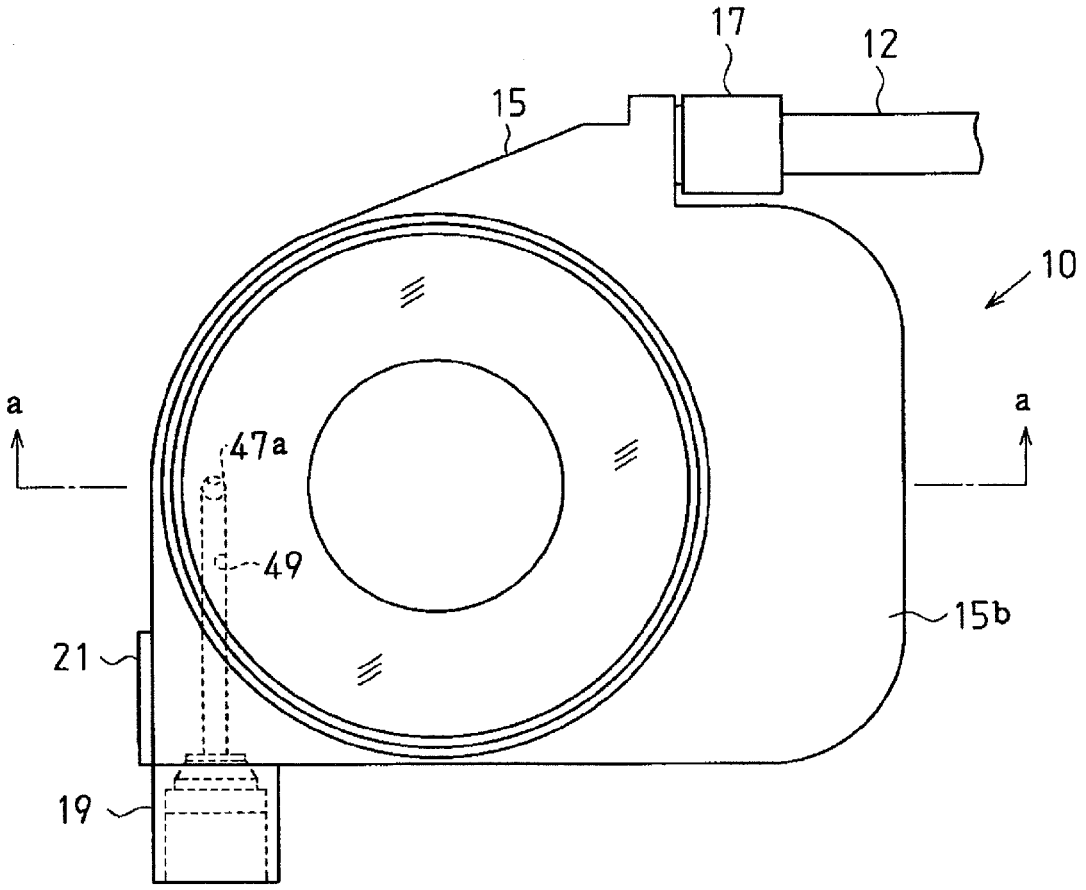
FIG. 4 is a side view of the attachment in the first embodiment.

The attachment 10 includes a unit case 15 made of synthetic resin which has a substantially circular and flat shape (cubical shape with a curved surface) as shown in FIGS. 3 and 4. The ink supply tube 12 is connected to a connection portion 17 formed on the upper portion of the unit case 15. In addition, on the lower portion of the unit case 15 is formed an ink outlet portion 19 serving as a connection portion, which is connected to the print head 8 through an ink supply needle (not shown) provided to project on the bottom surface of the carriage 5, similarly to a case of the ink cartridge 9. That is, the ink outlet portion 19 of the attachment 10 corresponds to an ink supplying opening of the ink cartridge 9, so that the ink outlet portion 19 can use a structure in which an ink supplying opening can be used. In addition, the unit case 15 has a storage means 21 in the vicinity of the ink outlet portion 19 as shown in FIG. 4, similarly to the existing ink cartridge 9.

Figure 5:
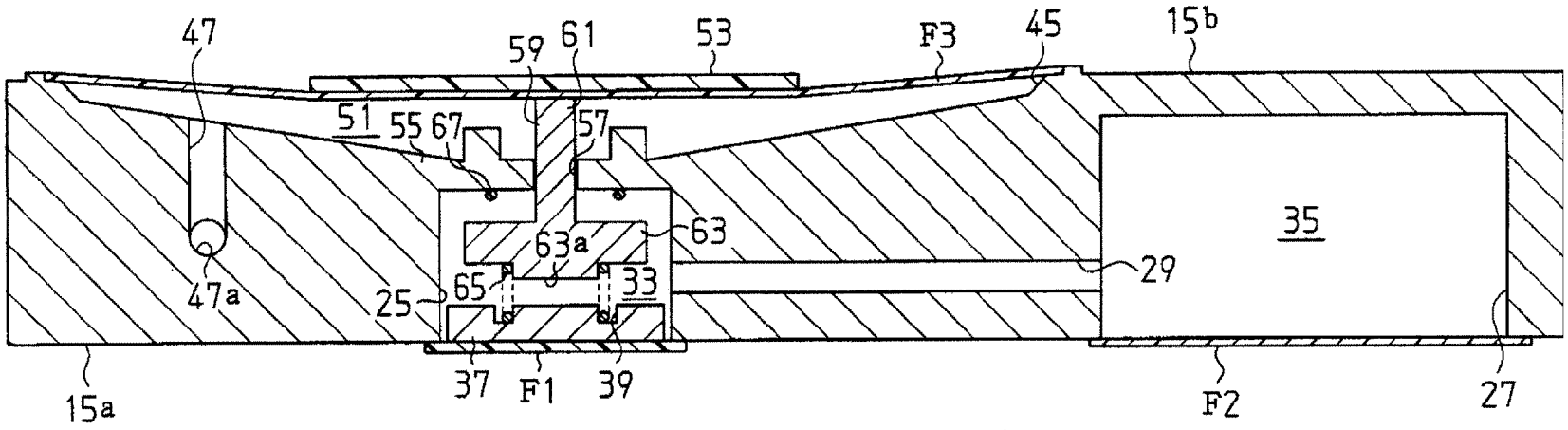
FIG. 5 is a cross-sectional view of the attachment in a valve-closed state, in the first embodiment.

FIG. 5 is a cross-sectional view of the attachment 10, which is taken along the line A-A in FIG. 4, and shows a pressure control means included in the attachment 10. As shown in FIG. 5, a small concave portion 25 having a substantially cylindrical shape is formed in the one side 15*a* of the unit case 15 as an attachment body. In addition, an ink containing concave portion 27 is formed in the one side 15*a*, which communicates with the connection portion 17. In the ink containing concave portion 27, an ink introducing path 29 is formed towards the small concave portion 25, an end of which communicates with the small concave portion 25. A first film member F1, which covers the small concave portion 25, and a second film member F2, which covers the ink containing unit 27, are respectively adhered to the one side 15*a* by heat welding. A substantially cylindrical ink supply chamber 33 serving as a first liquid supplying section and a flow passage is defined by the small concave portion 25 and the first film member F1, and a substantially cylindrical ink containing chamber 35 is defined by the ink containing concave portion 27 and the second film member F2. Accordingly, the ink flowed from the ink supply tube 12 flows in the ink supply chamber 33 via the connection portion 17, the ink containing chamber 35, and the ink introducing path 29.

Figure 12:
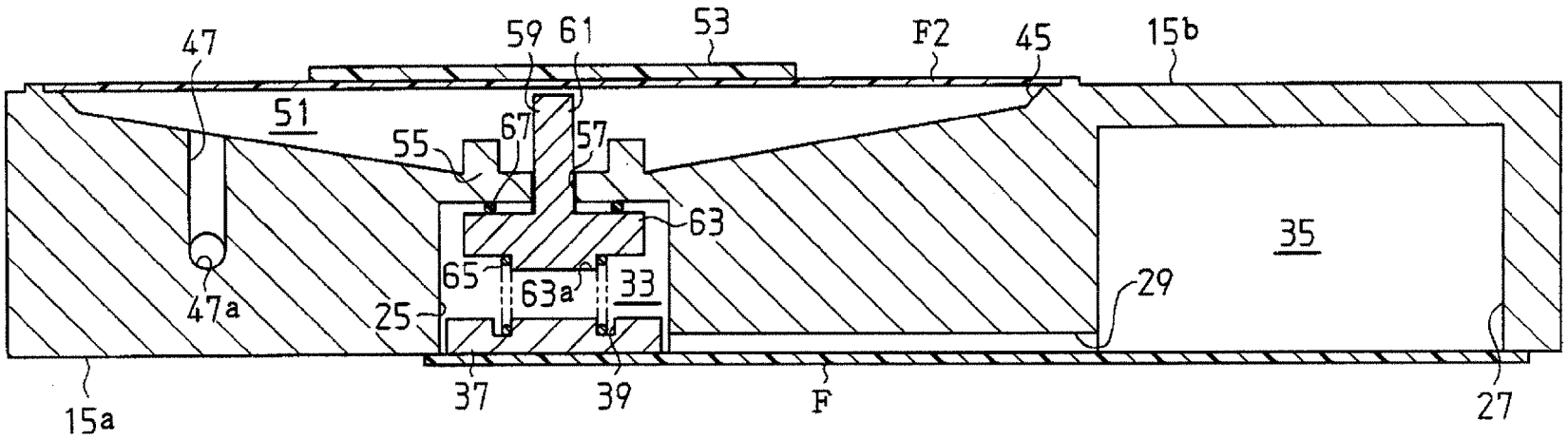
FIG. 12 is a cross-sectional view illustrating a modified example of the attachment in the first embodiment.

Further, a groove is formed in the one side 15*a* of the unit case 15 as shown in FIG. 12. The ink introducing path 29 may be formed so that the groove is covered by a single film F which covers the small concave portion 25 and the ink containing concave portion 27. In addition, it is preferable that the film F be adhered to the one side 15*a* by head welding the same as the films F1 and F2.

In addition, on a surface in the side of the first film member F1 within the ink supply chamber 33 is mounted a spring swivel plate 37 so as to be positioned concentrically with the ink supply chamber 33, which has an outer diameter slightly smaller than an inner diameter of the ink supply chamber 33. The spring swivel plate 37 has a annular groove 39 on the surface opposite the first film member F1.

In addition, a large concave portion 45 having a substantially truncated-cone shape is formed on the other side 15*b* of the unit case 15. The large concave portion 45 is provided so as to be positioned concentrically with the small concave portion 25, which has a larger diameter than that of the small concave portion 25. An ink leading-out path 47 is formed towards the one side 15*a* on the surface in the side of the large concave portion 45. As shown in FIG. 4, an end 47*a* of the ink leading-out path 47 communicates with a communication hole 49 formed in the ink outlet portion 19. Further, as shown in FIG. 5, a third film member F3 having a flexibility is adhered to the other side 15*b* by heat welding so as to close the large concave portion 45. A substantially truncated-cone pressure chamber 51 serving as a second liquid supplying section and a flow passage is defined by the large concave portion 45 and the third film member F3. Further, the third film member F3 is so flexible that it can effectively detect a negative-pressure state of the pressure chamber 51, and is made of a material which does not affect ink chemically. The ink within the pressure chamber 51 is discharged into the print head 8 via the ink leading-out path 47 and the communication hole 49 of the ink outlet portion 19.

In addition, on the surface of the third film member F3 opposite to the pressure chamber 51, a pressure receiving plate 53 having a circular-plate shape is adhered, for example, by heat welding so as to be positioned concentrically with respect to the pressure chamber 51, which is harder than the third film member F3. The pressure receiving plate 53 has an outer diameter smaller than the inner diameter of the pressure chamber 51, which is made of a light plastic material such as polyethylene or polypropylene.

A partition wall 55 is formed between the ink supply chamber 33 and the pressure chamber 51 of the unit case 15 so that the partition wall 55 partitions the ink supply chamber 33 and the pressure chamber 51. A support hole 57 is formed in the partition wall 55, which composes an opening and closing valve through which the ink supply chamber 33 communicates with the pressure chamber 51. A movable valve 59 is inserted and slidably supported in the support hole 57, which composes a switching value. More specifically, the movable valve 59 is composed of a cylindrical rod member 61 and a plate-shaped member 63 in which the cross section is circular. The plate-shaped member 63 is formed integrally with the rod member 61.

The plate-shaped member 63 is arranged in the side of the ink supply chamber 33, the outer diameter of which is larger than that of the rod member 61. The rod member 61, which extends from the plate-shaped member 63, is inserted and supported slidably in the support hole 57, of which a leading end projects into the pressure chamber 51.

Figure 6:
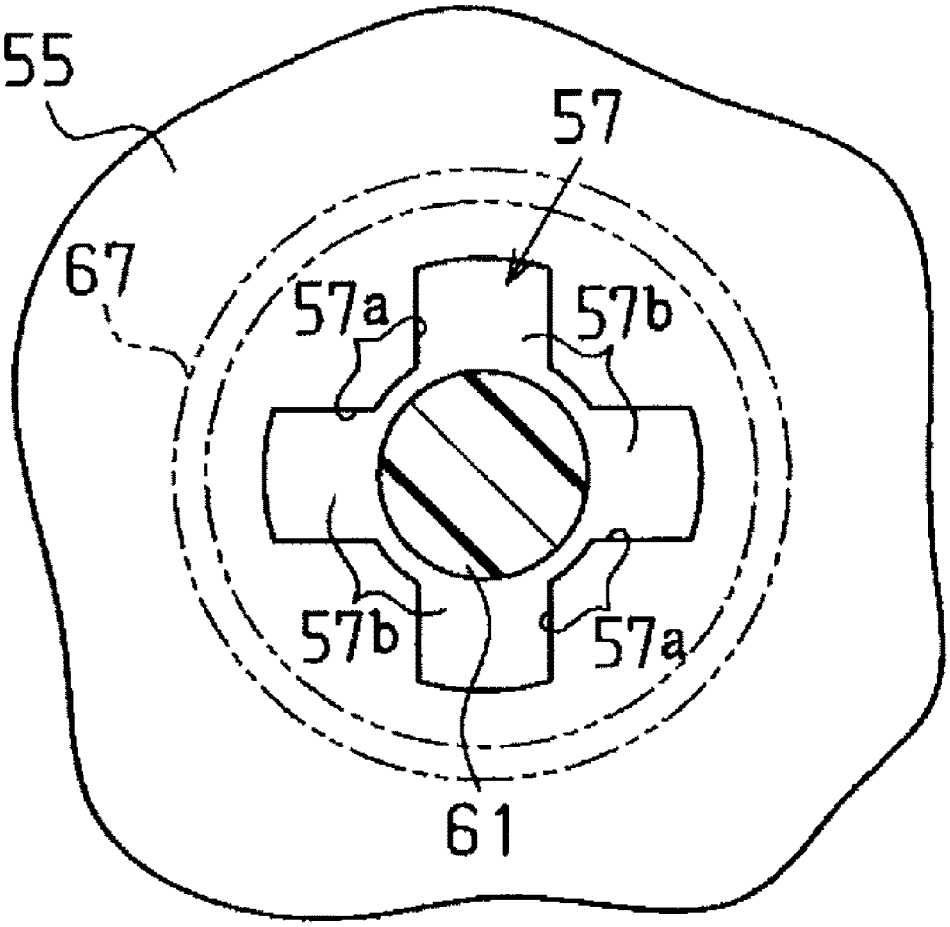
FIG. 6 is a partial cross-sectional view of the attachment in the first attachment.

As shown in FIG. 6, the support hole 57 has four cut-out grooves 57*a* thereon at equal intervals. Accordingly, in a state where the rod member 61 is inserted and supported in the support hole 57, four ink flow passages 57*b* are defined by the rod member 61 and four of the cut-out grooves 57*a*. In addition, the plate-shaped member 63 has an annular step portion 63*a* and a coil spring 65 is arranged between the step portion 63*a* and the groove 39 of the spring swivel plate 37, as shown in FIG. 5. The operation of the coil spring 65 causes the plate-shaped member 63 to be biased at all times to the side of the partition wall 55.

Meanwhile, as shown in FIG. 5 and FIG. 6, a seal member 67 made of rubber is mounted on the partition wall 55 in the side of the ink supply chamber 33, which is formed in a annular shape so as to surround the support hole 57. Accordingly, the plate-shaped member 63 in the movable valve 59 comes into contact with the seal member 67 by the biasing force of the coil spring 65. When the plate-shaped member 63 comes into contact with the seal member 67, four of the ink flow passages 57*b* are closed, that is, the interval between the ink supply chamber 33 and the pressure chamber 51 is blocked. On the contrary, if the plate-shaped member 63 moves toward the first film member F1 against the biasing force of the coil spring 65 to be spaced from the seal member 67, the ink supply chamber 33 communicates with the pressure chamber 51.

Preferably, the seal member 67 is integrated with the partition wall 55 by coinjection molding when the unit case 15 is formed. Similarly, the seal member 67 may be formed on the plate-shaped member 63 of the movable valve 59, not on the partition wall 55, to be spaced from the partition wall 55.

In the attachment 10 formed as above, spring load W1 by the coil spring 65 is applied to the plate-shaped member 63 of the movable valve 59 in a state where the print head 8 is not in the non-printing state, that is, it does not consume ink. In addition, applied force P1 of ink to be supplied to the ink supply chamber 33 is also applied to the plate-shaped member 63. As a result, the plate-shaped member 63 comes into contact with the seal member 67 made of rubber as shown in FIG. 5, so that the ink flow passage 57*b* (see FIG. 6) is in the valve-closed state. In other words, it goes into a state where the ink supply chamber 33 and the pressure chamber 51 does not communicate with each other and the attachment 10 seals itself.

Figure 7:
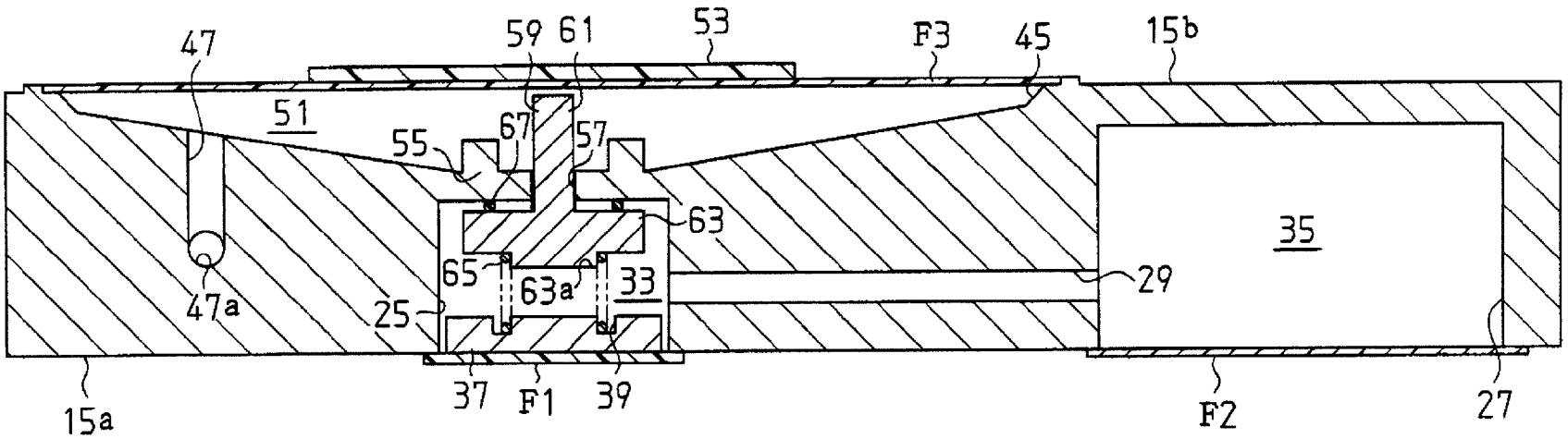
FIG. 7 is a cross-sectional view of the attachment in a valve-opened state, in the first embodiment.

Meanwhile, in a case where the print head 8 operates, that is, it consumes ink, the pressure chamber 51 is under a negative pressure as the ink of the pressure chamber 51 decreases and the third film member F3 is displaced towards the side of the ink supply chamber 33, such that the center portion of the third film member F3 comes into contact with the end of the rod member 61 which composes the movable valve 59. At this moment, a reaction force required for the displacement of the third film member F3 is referred to as Wd. Moreover, when the print head 8 consumes ink further, a negative pressure P2 is generated within the pressure chamber 51. At this time when the function of P2>W1+P1+Wd is achieved, the third film member F3 presses the rod member 61, so that the abutment between the plate-shaped member 63 and the seal member 67 is released. As a result, the ink flow passage 57*b* (see FIG. 6) is changed into a valve closing state as shown in FIG. 7. Furthermore, the ink within the ink supply chamber 33 is supplied into the pressure chamber 51 through the ink flow passage 57*b* from the ink supply chamber 33 to the pressure chamber 51.

In fact, even though the applied force P1 of ink supplied to the ink supply chamber 33 becomes large, the valve closing state is maintained, if a negative pressure P2, which exceeds the applied force P1, is not generated within the pressure chamber 51. That is, the pressure variation of ink within the pressure chamber 51 is suppressed in a certain constant range by opening and closing the movable valve 59, so that the ink within the pressure chamber 33 is cut off from pressure variation. Accordingly, the ink level of the outer ink tank 11 is varied depending on the arranged position of the outer ink tank 11 or the amount of ink remaining in the outer ink tank. Even if the ink pressure within the ink supply chamber 33 is varied, it does not affect anything. As a result, the weight of ink drops ejected from the pressure chamber 51 to the print head 8 is maintained constant so that a printing quality does not vary.

If ink flows in the pressure chamber 51, the negative pressure P2 of the pressure chamber 51 is released and the function of P2<W1+P1+Wd is achieved. In accordance with this, the movable valve 59 moves so that the valve is come back to the closed state as shown in FIG. 5 and the ink supply into the pressure chamber 51 from the ink supply chamber 33 is stopped.

The opening and closing valve of the movable valve 59 need not to always perform such extreme operations, by winch the states shown in FIGS. 5 and 7 are repeated. From a practical point of view, a state of equilibrium is secured in the printing operation, where the third film member F3 comes into contact with the end of the rod member 61 which composes the movable valve 59. Also, the movable valve 59 operates so that ink is gradually supplemented to the pressure 51, while the valve is slightly opened as ink is consumed.

Figure 8:
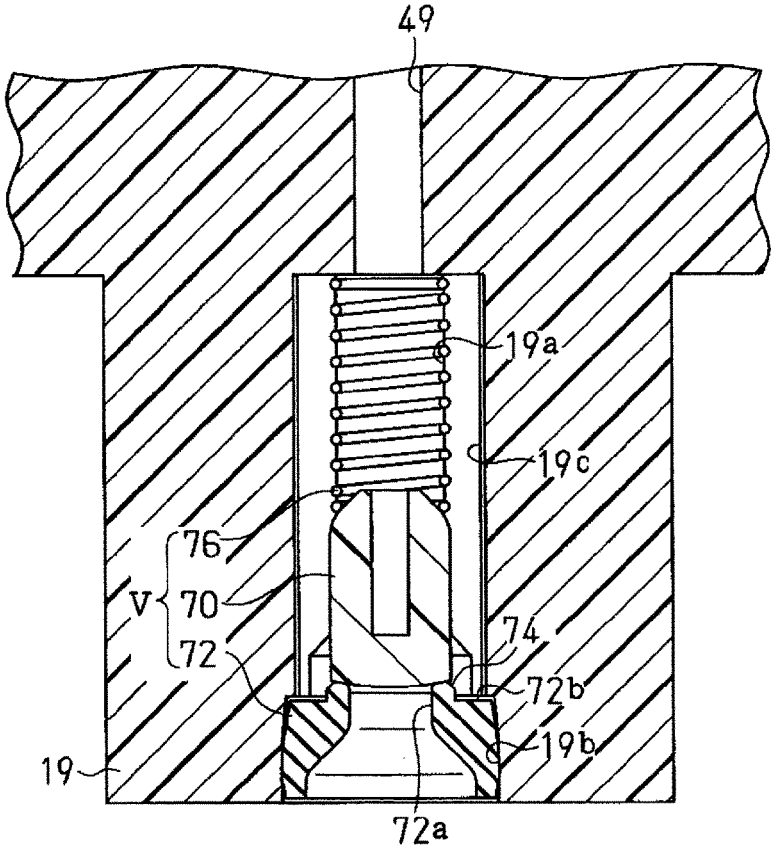
FIG. 8 is a partial cross-sectional view of the attachment in the first attachment.

A valve device V as an opening and closing valve provided in the ink outlet portion 19 will be described with reference to FIGS. 4 and 8.

As shown in FIG. 4, the communication hole 49 is opened in the ink outlet portion 19, which communicates with the pressure chamber 51 through the ink leading-out path 47. As shown in FIG. 8, in the ink outlet portion 19 are formed a valve hole 19*a*, which communicates with the communication hole 49, and a leading-out hole 19*b*. A plurality of communication grooves 19*c* are formed on an inner circumferential surface of the valve hole 19*a*. Herein, the communication grooves 19*c* are formed in two sections on an inner circumferential surface of the valve hole 19*a*. The leading-out hole 19*b*, opened outside, has a inner diameter larger than that of the valve hole 19*a*.

In addition, the valve device V is provided in the valve hole 19*a* and the leading-out hole 19*b* formed in the ink outlet portion 19. The valve device V includes a valve body 70 and a seal member 72. An outer diameter of the valve body 70 is the substantially same as an inner diameter of the valve hole 19*a*. The valve device V is arranged slidably in a direction of the central axis of the valve hole 19*a*.

The seal member 72 is fitted into the leading-out hole 19*b*. The seal member 72 is made of a flexible material such as elastomer and is formed in a substantially cylindrical shape. An insertion hole 72*a* passing through the center of the seal member 72, whose diameter in the side of the valve body 70 is such a diameter at which the ink supply needle (not shown) provided on the bottom surface of the carriage 5 fits firmly, is formed in an expanded manner towards the leading-out side. A valve seat 74 is provided to projects so as to surround the opening of the insertion hole 72*a* at the base end surface 72*b* of the seal member 72. The valve body 70 is seated on the valve seat 74, so that the insertion hole 72*a* of the seal member 72 is closed by the valve body 70. Further, the ink supply needle is formed to be hollow, to allow ink to flow inside of the ink supply needle through the hollow.

Further, the valve device V includes a coil spring 76 which biases the valve body 70. The coil spring 76 is fixedly supported inside the valve hole 19*a* so as to bias the valve body 70 to the side of the seal member 72. When a force is not applied from outside, the coil spring 76 biases the valve body 70 so that the valve body 70 comes into pressure-contact with the valve seat 74 of the seal member 72, as shown in FIG. 8. When an ink supply needle is inserted into the valve body 70 through the insertion hole 72*a* of the seal member 72, the valve body 70 moves towards a direction away from the seal member 72 against the biasing force of the coil spring 76. At this time, the leading end of the ink supply needle is inserted in a state where it is sealed by the seal member 72. In addition, when the valve body 70 becomes separated from the seal member 72, the hole of the ink supply needle is connected to the valve hole 19*a* and the communication hole 19*c* disposed on the opposite side with the valve body 70 interposed therebetween. Accordingly, if the ink within the pressure chamber 51 is introduced to the ink outlet portion 19, the ink is guided into the valve hole 19*a* in the side of the seal member 72 with the valve body 70 interposed, through the communication groove 19*c*. The ink flows in the print head 8 from the hole of the ink supply needle.

Next, an electrical configuration of the printer 1 having the above-described configuration will be described with reference to FIG. 9.

Figure 9:
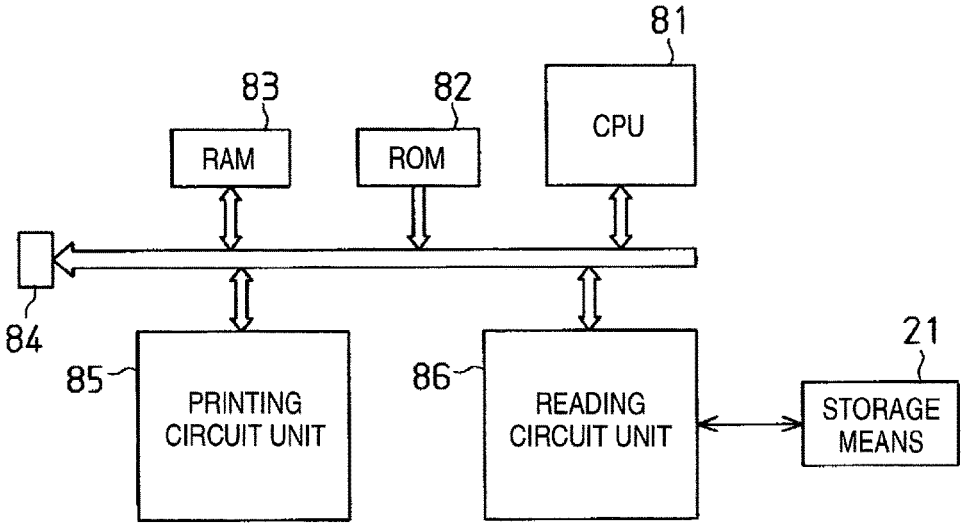
FIG. 9 is a block diagram illustrating an electrical configuration of the printer in the first embodiment.

As shown in FIG. 9, the printer 1 includes a CPU 81, a ROM 82, a RAM 82, a RAM 83, an interface 84, a printing circuit unit 85, and a reading circuit unit 86.

The CPU 81 receives printing data and the like, from an outer device through the interface 84 according to the program stored in the ROM 82, and stores them temporarily in the RAM 83. In addition, the CPU 81 controls the printing circuit unit 85 on the basis of the printing data stored in the RAM 83 according to the program stored in the ROM 82, so that the carriage 5 and the print head 8 are driven to eject ink on the printing paper. In addition, the CPU 81 receives data (liquid information) which are stored in a storage means (not shown) provided in the ink cartridge 9 mounted on the carriage 5, through the reading circuit unit 86. The information stored in the storage means (not shown) provided in the ink cartridge 9 includes ink property information such as the total amount of ink, the amount of consumed ink, the amount of ink remaining in the ink cartridge 9, and ink color and data such as a kind of the ink cartridge 9, how many times it is mounted, and its manufactured date. The CPU 81 updates contents of the storage means with known method through the reading circuit unit 8G, whenever printing is performed with the ink of the ink cartridge 9.

In addition, the CPU 81 receives the data (liquid information) which are stored in the storage means 21 provided in the attachment 10 mounted on the carriage 5, through the reading circuit unit 8G. The liquid information stored in the storage means 21 provided in the attachment 10 includes ink property information such as the total amount of ink, the amount of consumed ink, the amount of ink remaining in the outer ink tank 11, and ink color and data such as a kind of the outer ink tank 11, how many times it is mounted, and its manufactured date. The CPU 81 updates contents of the storage means 21 the same as in the ink cartridge 9 through the reading circuit unit 86, whenever printing is performed with the ink of the outer ink tank 11.

Although the rewritable storage means 21 is provided in the ink tank 11 to store an amount of remained ink in the storage means 21 of the outer ink tank 11 in the above example, a read-only storage means (ROM) may be provided in the outer ink tank 11. In this case, the ROM of the outer ink tank 11 stores an identification number (ID) which is unique to the outer ink tank 11. An amount of remained ink is calculated from the amount of consumed ink calculated by a known method such as dot count or the like. The amount of remained ink is associated with the read identification number from the ROM of the outer ink tank 11 to be stored in a printer memory, so that an amount of remained ink can be managed in a printer.

The total amount of ink (initial amount of ink) may be obtained by a following method, which is required for first calculating an amount of remained ink from the amount of consumed ink. In the case of structure where the attachment 10, the ink supply tube 12, and the outer ink tank 11 are integrated with one another so that only the outer ink tank 11 can not be replaced, the whole amount of ink contained in the attachment 10, the ink supply tube 12, and the outer ink tank 11 is stored as the total amount of ink in the ROM of the ink tank 11, so that the printer can grasp the total amount of ink using the reading circuit unit 86.

Figure 13:
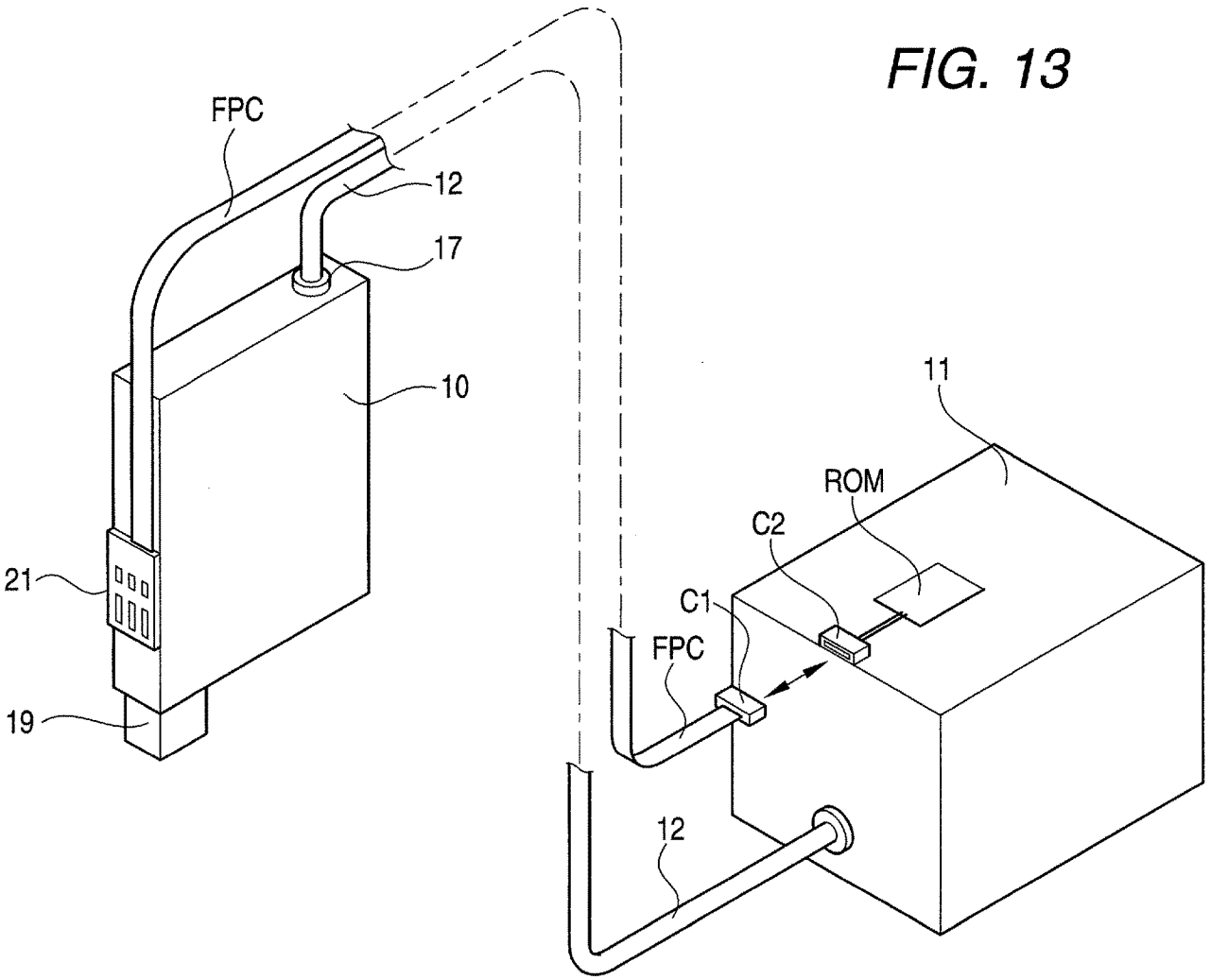
FIG. 13 is a schematic view illustrating an example in which a read-only-memory (ROM) is provided in an external inductance.

When the outer ink tank 11 is removable from the ink supply tube 12 and only the outer ink tank 11 can be replaced, the outer ink tank 11 is also provided with ROM to store the total amount of ink of the outer ink tank 11 in the ROM, as schematically shown in FIG. 13. When the outer ink tank 11 is connected to the ink supply tube 12, it extends along the ink supply tube 12. A flexible cable (FPC), which is electrically connected to an electrode provided in the storage means (board) 21 of the attachment 10, or an electric-cable connector C1 is provided in the outer ink tank 11 and is connected to a connector C2 connected to the ROM of the outer ink tank 11. As a result, the printer 1 can grasp the data on the total amount of ink of the outer ink tank 11 from the ROM of the outer ink tank 11, through the flexible cable (FPC) or the electric cable, the electrode of the storage means (board) 21, and the reading circuit 86. By adding the obtained total amount of ink of the outer ink tank 11 to the total amount of ink of the attachment 10 stored in the ROM of the attachment 10, the printer can grasp the total amount of the attachment system as a whole.

Instead of the above configuration, a following method can be available. With a printer driver which can be installed in a PC, which is one of outer devices connectable to the interface 84, an input screen for the total amount of ink is displayed on the PC. User reads the total amount of the outer ink tank 11 displayed on a label appended to the outer ink tank 11 or the total amount of ink of the outer ink tank 11 indicated in a manual which is packed together with the outer ink tank 11, inputs into PC the total amount of ink of the outer ink tank 11 using an input device of the PC and the input screen for the total amount of ink, and provides the total amount of ink to the printer 1 through the printer driver and the interface 84. As a result, the printer 1 can grasp the total amount of ink of the outer ink tank 11.

Figure 14:
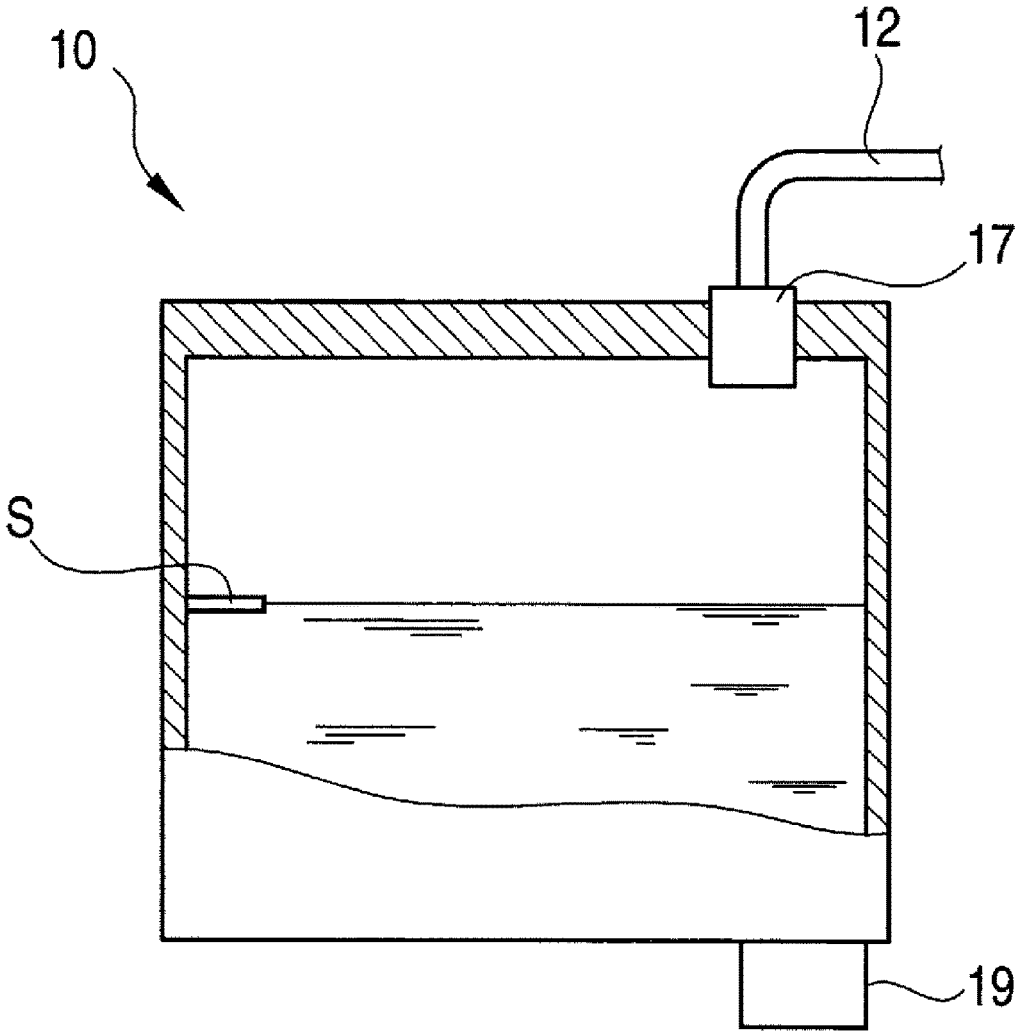
FIG. 14 is a schematic view illustrating an example in which an ink level sensor is provided in the attachment.

In case of the attachment system of the present invention, since the total amount of ink as a whole is, for example, three to ten times larger than the total amount of ink in the ink cartridge 9, it is likely to make an error in detecting the amount of remained ink with a software method such as a dot count. Accordingly, under detection of the amount of remained ink, a calibration may be performed. For example, a known ink level sensor such as a pair of electrodes or a piezoelectric sensor is disposed inside the attachment 10, as schematically shown in FIG. 14. The ink level sensor detects the ink level at the time when all the ink of the outer ink tank 11 is consumed and further, a part of ink of the attachment 10 is consumed so that the amount of ink remaining in the attachment 10 becomes a predetermined amount. At this moment, the value for the amount of remained ink, which has been calculated so far in a software count, is cleared and the amount of remained ink is newly calculated from the predetermined amount by the software count. Accordingly, until the ink amount of the attachment 10 becomes the predetermined amount, the calculation error, which can be accumulated in the software count, can be corrected. The predetermined amount is stored in the storage means 21 in advance and further the output of the ink level sensor S can be outputted into the printer through the electrode provided on the board of the storage means 21. Accordingly, the printer can grasp the time when the amount of the ink remaining in the attachment 10 becomes the predetermined amount through the reading circuit unit 86 or the like.

Further, when the ink level sensor S is disposed in the attachment 10, the software count may not be performed until the ink amount of the attachment 10 becomes the predetermined amount. Accordingly, a means through which the printer grasps the total amount of ink of the outer ink tank 11 can be omitted.

Next, an operation of the attachment and the printer configured as above will be described.

When printing is performed with the outer ink tank 11 in place of the ink cartridge 9, user mounts the attachment 10 on the carriage 5 and connects the attachment 10 to the outer ink tank 11 through the ink tank tube 12. The attachment 10 is compatible with the ink cartridge 9 on a shape mounted with respect to the print head 8, whereby it can be mounted on the carriage 5 in place of the ink cartridge 9. If ink drops are ejected from the print head 8 to perform printing, the ink from the outer ink tank 11 is supplied to the attachment 10, so that the ink supplied to the attachment 10 is supplied to the print head 8 through the carriage 5.

In this case, the pressure control means is provided between the ink supply chamber 33 and the pressure chamber 51 in the attachment 10. The pressure control means is composed of the movable valve 59, the coil spring 65, the seal member 67, and so on. Therefore, a place where the outer ink tank 11 is disposed (ink level of the outer ink tank 11) may be higher than the print head 8, that is, a differential head may exist. Accordingly, a degree of freedom becomes high in a place where the outer ink tank 11 is disposed away from the carriage 5. In addition, the valve device V is provided in the ink outlet portion 19, whereby ink does not leak or air is not intruded from the attachment 10 to the ink supply tube 12 and the outer ink tank 11, even when a posture of the attachment 10 is changed by removing the attachment 10 from the print head 8 or carrying the printer 1 somewhere.

The printer 1 calculates the amount of consumed ink whenever printing is performed with the ink of the outer ink tank 11. However, the printer 1 can calculate the amount of ink remaining in the outer ink tank 11 from information on the amount of consumed ink and the information on the storage means provided in the attachment 10. Based on the data on the amount of remained ink, the printer 1 can perform printing effectively the same as it does when the ink cartridge 9 is used.

According to the above-described embodiment, following advantages can be obtained.

(1) According to the present embodiment, in the attachment 10, which is compatible with the ink cartridge 9 on the mounted shape with respect to the print head 8, is provided the pressure control means (valve device) which is composed of the movable valve 59, the coil spring 65, and the seal member 67. Accordingly, since the ink under a constant pressure can be always supplied to the print head 8 regardless of the amount of ink remaining in the outer ink tank 11, a uniform printing quality can be secured.

(2) According to the present embodiment, the pressure control means (valve device), composed of the movable valve 59, the coil spring 65, and the seal member 67 which are provided in the attachment 10, causes the pressure chamber 51 of the attachment 10 to receive the ink from the ink supply chamber 33 as the ink therein decreases. Therefore, the pressure variation of ink within the pressure chamber 51 is limited to be held within a certain constant range. In other words, even though the applied force P1 of ink to be supplied to the ink supply chamber 33 becomes large, the valve-closing state is maintained, if a negative pressure P2, which exceeds the applied force P1, is not generated within the pressure chamber 51. Thus, even if the pressure variation is generated in the upstream (the side of the outer ink tank 11) over the pressure 51, the print head 8 is not affected by that. As a result, the ink level of the outer ink tank 11 is varied according to the arranged place of the outer ink tank 11 or the amount of remained ink, even when the ink pressure within the ink supply chamber 33 is varied, whereby the ink level is not affected by that. Hence, the degree of freedom increases in the arranged place of the outer ink tank 11.

(3) According to the present embodiment, the ink from the outer ink tank 11, which contains a larger amount of ink than the ink cartridge 9, can be supplied to the print head 8, since the attachment 10, which is compatible with the ink cartridge 9 on the shape mounted with respect to the print head 8, is mounted on the carriage 5. Accordingly, labor hour for replacing ink cartridges and a running cost can be reduced.

(4) According to the present embodiment, the storage means 21 is provided in the attachment 10, whereby information on ink properties or information on the outer ink tank 11 can be identified correctly, even though the attachment 10 in place of the ink cartridge 9 is mounted on the carriage 5. Therefore, printing can be performed normally as in the case that the ink cartridge 9 is mounted on the carriage 5.

Second Embodiment

Next, the second embodiment of the present invention will be described with reference to FIG. 10. The present embodiment is characterized by a configuration which has the pressure control means (valve device) described in the first embodiment. Therefore, like reference numerals are used to denote identical elements of the first embodiment in the following embodiment and the detailed description of that will be omitted.

Figure 10:
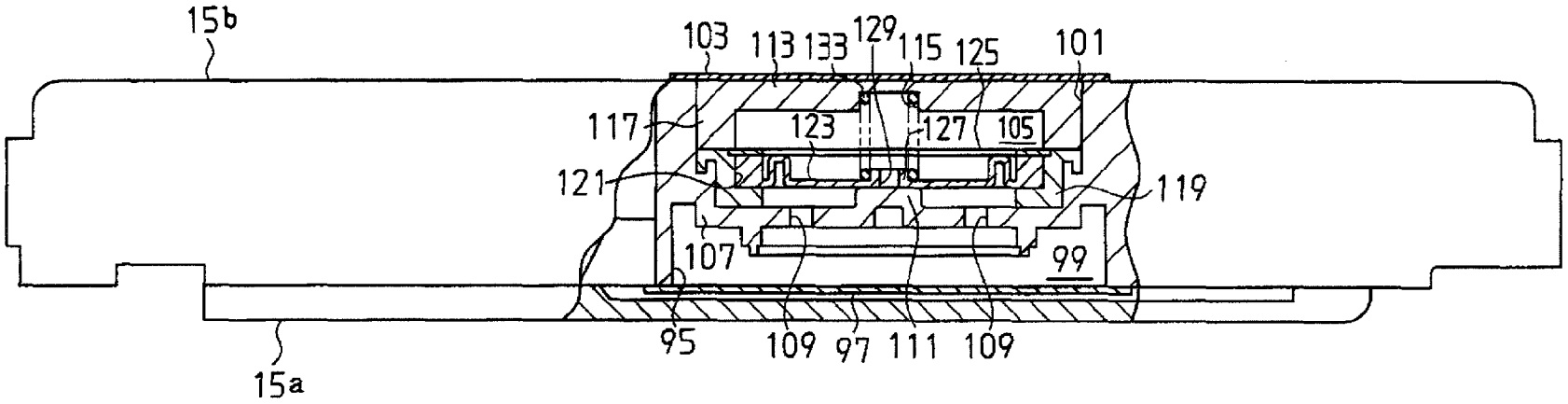
FIG. 10 is a cross-sectional view of essential parts of an attachment in a second embodiment.

FIG. 10 is a cross-sectional view of essential parts of the attachment 10.

As shown in FIG. 10, a first concave portion 95 having a substantially cylindrical shape is formed in the one side 15*a* of the unit case 15, which communicates with the connection portion 17. A film member 97, which covers the first concave portion 95 is adhered to the one side 15*a* by heat welding. Accordingly, a substantially-cylindrical ink supply chamber 99 serving as a first liquid supplying section and a flow passage is defined by the first concave portion 95 and the film member 97. Further, the ink from the ink supply tube 12 flows in the ink supply chamber 99 through the connection portion 17.

As shown in FIG. 10, a second concave portion 101 having a substantially cylindrical shape is formed in the other side 15*b* of the unit case 15, which communicates with the ink outlet portion 19. A film member 103, which covers the second concave portion 101 is adhered to the other side 15*b* by heat welding. Accordingly, a substantially-cylindrical ink leading-out chamber 105 serving as a second liquid supplying section and a flow passage is defined by the second concave portion 101 and the film member 103.

In a partition wall 107 which partitions the ink supply chamber 99 and the ink leading-out chamber 105 are formed a plurality of through-holes 109. In addition, a support convex portion 111, which projects into the ink leading-out chamber 105, is formed in the center of the partition wall 107.

On a surface in the side of the film member 103 within the ink leading-out chamber 105 is mounted a spring swivel plate 113 having a outer diameter slightly smaller than the inner diameter the ink leading-out chamber 105, which is positioned concentrically with the ink leading-out chamber 105. In the center portion of the spring swivel plate 113, a groove 115 is formed on the surface opposite the film member 103. Further, in the outer circumferential portion of the spring swivel portion 113, an annular convex portion 117 projects out of the surface opposite the film member 103.

A valve accommodating cylinder portion 119 having a cylindrical shape is arranged between the spring swivel plate 113 and the partition wall 107. In the valve accommodating cylinder portion 119, a fitting portion 121 is formed in an expanded manner and the membrane valve 123 is fitted into the fitting portion 121. And, the membrane valve 123 is supported so as not to be pulled out from the valve accommodating cylinder portion 119, by a pull-out prevention ring having a circular shape which is interposed and fixed between the spring swivel 113 and the valve accommodating cylinder portion 119. The membrane valve 123 is made of a material such as elastomer which is elastically deformable and a convex portion 127 is formed in the center position opposite the support convex portion 111. In the center of the convex portion 127 is formed a cylindrical through-hole 129. The membrane valve 123 partitions the ink leading-out chamber 105 into the spring swivel plate 113 and the partition wall 107. And, if the convex portion 127 comes into contact with the support convex portion 111, the through-hole 129 formed in the convex portion 127 is closed by the support convex portion 111 to block the side of the spring swivel plate 113 of the ink leading-out chamber 105 and the side of the partition wall 107, that is, the ink leading-out chamber 105 does not communicate with the ink supply chamber 99.

On the contrary, if the convex portion 127 gets separated from the support convex portion 111, the through-hole 129 formed in the convex portion 127 is opened, so that the spring swivel plate 113 of the ink leading-out chamber 105 communicates with the partition wall 107, that is, the ink leading-out chamber 105 communicates with the ink supply chamber 99.

Within the ink leading-out chamber 105, a coil spring 133 is interposed between the convex portion 127 of the membrane valve 123 and the concave portion 115 of the spring swivel plate 113. The through-hole 129 of the membrane valve 123 is biased by the coil spring 133 so as to abut towards the support convex portion 111. Accordingly, in a state where no force is applied from outside, the trough-hole 129 is closed by the support convex portion 111. Further, the present embodiment includes the valve device composed of the support convex portion 111, the membrane valve 123, and the coil spring 133.

In the attachment 10 having such a configuration as above, spring load W1 by the coil spring 113, a applied force P3 of ink within the ink supply chamber 99, and an ink pressure P4 within the ink leading-out chamber 105 are applied to the membrane valve 123, when the print head 8 is not in the non-printing state, that is, ink is not being consumed. As a result, the membrane valve 123 comes into contact with the support convex portion 111 and the through-hole 129 changes to the valve closing state, as shown in FIG. 10. In other words, the ink supply chamber 99 does not communicate with the ink leading-out chamber 105 and the attachment 10 seals itself.

Meanwhile, in the case where the print head is in a printing state to consume ink, the ink pressure P4 within the ink leading-out chamber 105 becomes smaller than the applied force P3 of ink within the ink supply chamber 99, as the ink of the ink leading-out chamber 105 decreases. Further, a reaction force required for the displacement of the membrane valve 123 at this time is assumed to be Wd. As the ink is further consumed in the print head 8, the ink pressure P4 within the ink leading-out chamber 105 also decreases. At this time when the function of $|P3-P4| \geq W1+Wd$ is achieved, the membrane valve 123 becomes separated from the support convex portion 111 and the ink supply chamber 99 can communicate with the ink leading-out chamber 105.

Accordingly, the ink within the ink supply chamber 99 is supplied into the ink leading-out chamber 105 from the ink supply chamber 99 through the through-hole 129 and the negative pressure of the ink leading-out chamber 105 is released by the ink flow into the ink leading-out chamber 105. As a result, the membrane valve 123 moves so that the valve is closed again as shown in FIG. 10, the ink supply from the ink supply chamber 99 to the ink leading-out chamber 105 is stopped.

In fact, if the differential pressure is generated between the applied force P3 of ink supplied to the ink supply chamber 99 and the ink pressure P4 within the ink leading-out chamber 105 and the differential pressure does not exceed the sum of the spring load W1 by the coil spring 133 and the reaction force Wd required for the displacement of the membrane valve 123, the valve-closed state is maintained. That is, the pressure variation of ink within the ink leading-out chamber 105 is limited to be maintained within a certain constant range, by opening and closing of the membrane valve 123. And, even though the ink pressure within the ink supply chamber 99 is varied, the ink leading-out chamber 105 is not affected by pressure variation, if the differential pressure between the applied force P3 of ink within the ink supply chamber 99 and the ink pressure P4 within the ink leading-out chamber 105 is equal to or lower than the sum of the spring load W1 by the coil spring 133 and the reaction force Wd required for the displacement of the membrane valve 123. As a result, the weight of ink drops ejected from the pressure chamber 105 to the print head 8 is maintained constant so that a printing quality does not vary.

According to the above embodiment, following advantages are obtained in addition to (3) and (4) of the first embodiment.

(1) According to the present embodiment, the attachment 10 which is compatible with the ink cartridge 9 on the mounted shape with respect to the print head 8 is provided with the pressure control means (valve device) which is composed of the support convex portion 111, membrane valve 123, and the coil spring 133. Accordingly, ink with a constant pressure can be supplied to the print head 8, so that a unvarying printing quality can be secured.

Third Embodiment

Next, the third embodiment of the present invention will be described with reference to FIG. 11. Since the present embodiment is characterized by a configuration which has the pressure control means (valve device) described in the first embodiment and the second embodiment, like reference numerals are used to denote identical elements of the first embodiment and the second embodiment in the following embodiment and the detailed description of that will be omitted.

Figure 11:
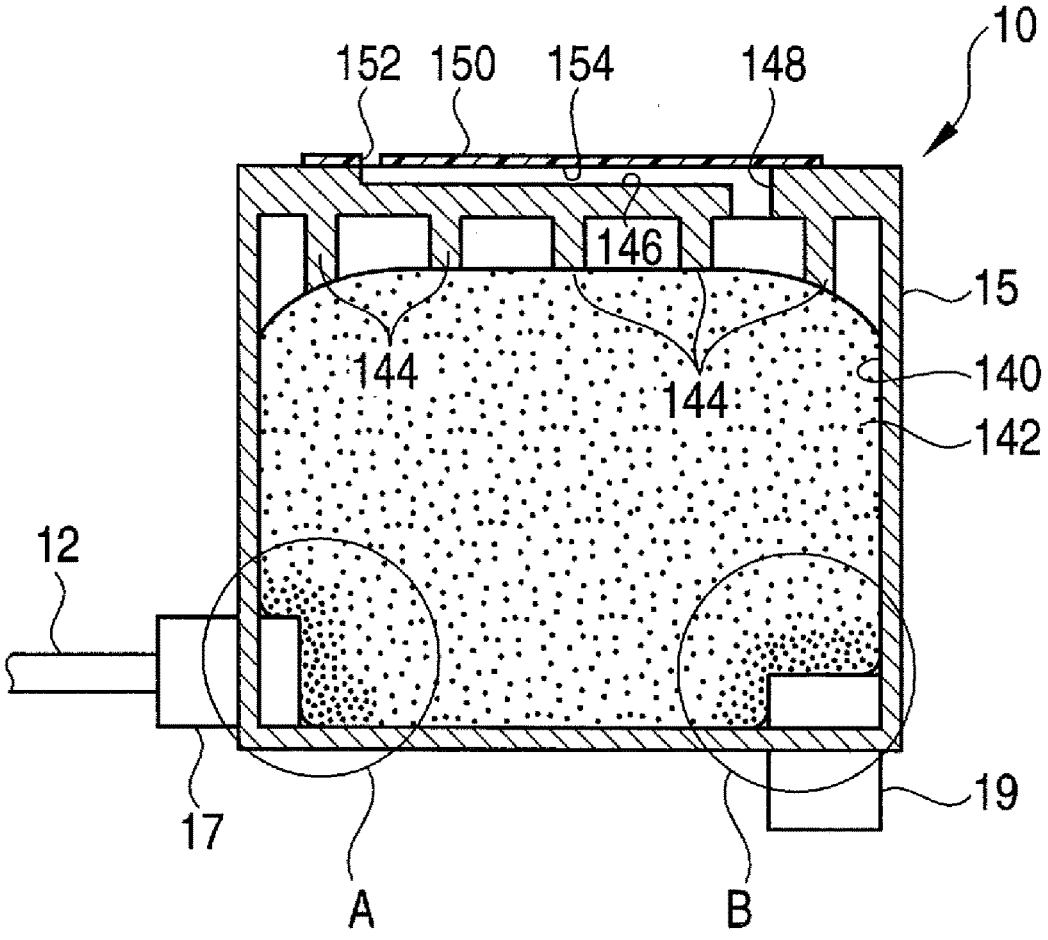
FIG. 11 is a partial cross-sectional view of an attachment in a third embodiment.

FIG. 11 is a partial cross-sectional view of an attachment 10.

As shown in FIG. 11, the unit case 15 of the attachment 10 includes an ink supply chamber 140 for containing ink therein, the ink of the outer ink tank 11 (not shown) is introduced from the connection portion 17 through the ink supply tube 12, and the ink is supplied to the print head 8 from the ink outlet portion 19.

A porous body 142 as a porous member is accommodated in the ink supply chamber 140. The porous body 142 temporarily holds the ink from the outer ink tank 11 to supply the held ink to the print head 8 from the ink outlet portion 19. By a capillary force of the porous body 142, the ink pressure within the attachment 10 become slightly smaller than that of the print head 8. Accordingly, the ink leakage from the print head 8 is reduced, whereby the weight of ink drops ejected from the attachment 10 to the print head 8 is maintained constant so that a printing quality does not vary.

As shown in FIG. 11, the connection portion 17 projects into the attachment 10 to compress an A portion of the porous body 142. Similarly, the ink outlet portion 19 projects into the attachment to compress a B portion of the porous body 142. The compressibility of the porous body 142 in the B portion is higher than that of the porous body 142 in the A portion, so that the capillary force of the porous body 142 in the B portion is higher than that of the porous body 142 in the A portion.

If the ink within the attachment 10 is consumed by the print head 8, the water head difference between the outer ink tank 11 and the print head 8 and the capillary force of the porous body 142 in the A portion are cooperated to thereby supplement the ink of the outer ink tank 11 into the attachment 10. Since the B portion of the porous body 142 has the highest capillary force among the portions of the porous body 142, the ink of the outer ink tank 11 flows smoothly in the ink outlet portion 19, as ink is consumed by the print head 8.

If all the ink of the outer ink tank 11 is consumed, ink is held in the A portion where a compressibility of the porous body is slightly high and the ink within the attachment 10 (ink which is absorbed in the porous body 142) flows smoothly into the ink outlet portion 19, as ink is consumed by the print head 8.

The ink within the attachment 10 is constantly held in the A portion, where a compressibility of the porous body is high, in the process during which the ink is consumed in the print head 8, thereby preventing air from flowing backwards into the outer ink tank 11 through the ink supply tube 12. In particular, in the case of a structure in which the outer ink tank 11 can be removed from the ink supply tube 12 and only the outer ink tank 11 can be replaced, no bubble is mixed into the ink supply tube 12. Therefore, simply by connecting a new outer ink tank 11 to the ink supply tube 12, the outer ink tank 11 communicates with the attachment 10, which makes it possible for the ink of the ink supply tube 12 to pass through them.

A plurality of pins 144 projects out of the upper inner side of the unit case 15 to fixedly support the top surface of the porous body 142, so that a small gap is formed in the upper portion of the ink supply chamber 140.

A concave portion 146 is provided on the top surface of the unit case 15 and a through-hole 148 communicating with the ink supply chamber 140 is formed in the one side of bottom surface of the concave portion 146. In addition, on the top surface of the unit case 15, a film member 150 is adhered by heat welding with respect to the unit case 15, so that it closes the concave portion 146. In the film member 150, an air communication hole 152 is formed in a position where it is the farthest away from the through-hole 148 and an air communication path 154 is defined by the air communication hole 152, the concave portion 146, and the through-hole 148. Since the air communication path 154 is provided in a position where the through-hole 148 is away from the air communication hole 152, the path can be made long and thin. As a result, an ink evaporation within the ink supply chamber 140 can be suppressed.

According to the above-described embodiment, since the porous body 142 is accommodated within the attachment 10, the configuration of the present embodiment can be made significantly simple at a low cost, compared to that of the first embodiment and the second embodiment.

In addition, the ink flow within the porous body 142 arranged in the attachment 10 can be made optimal.

Fourth Embodiment

Figure 15:
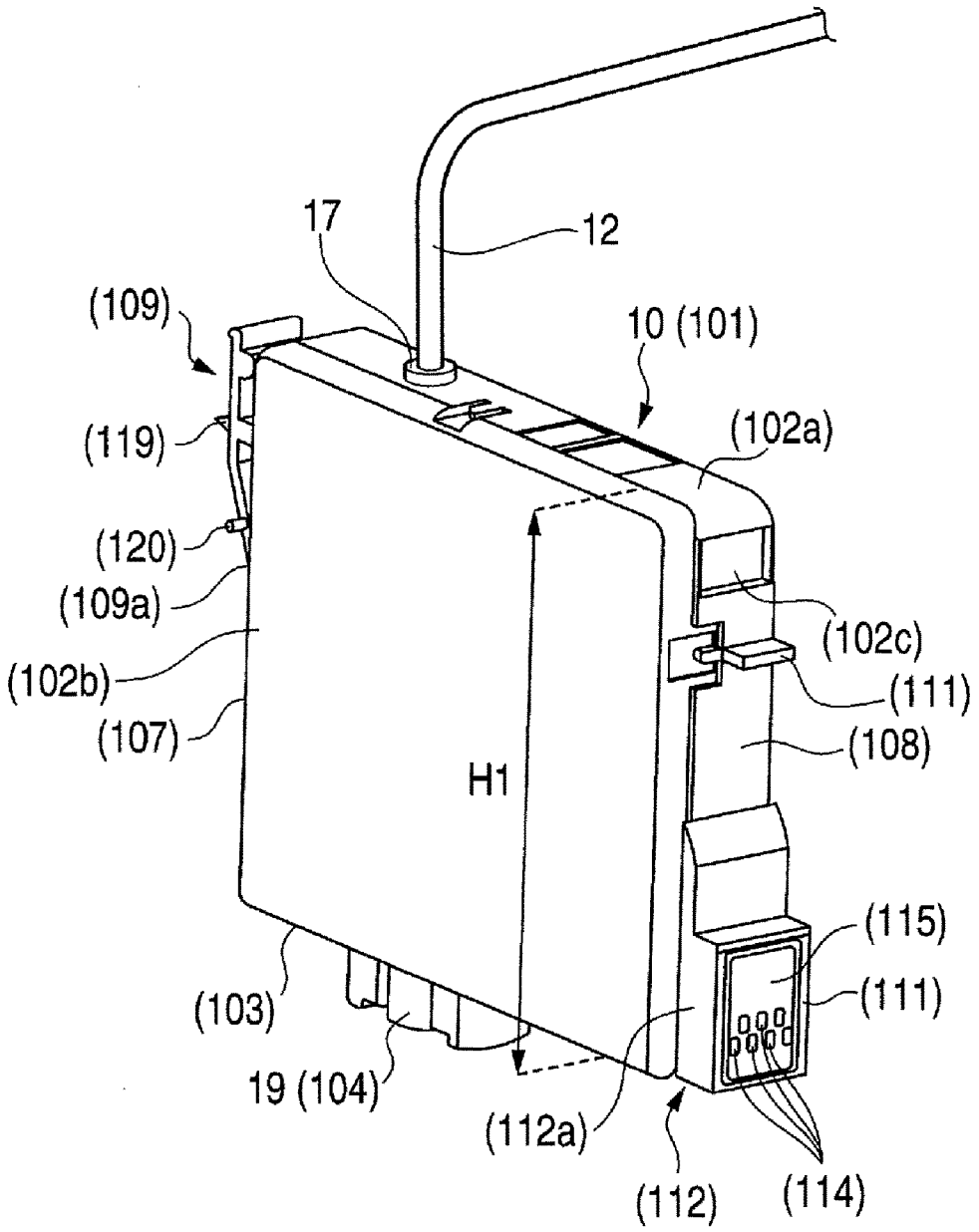
FIG. 15 is an exterior view illustrating an attachment in a fourth embodiment.

Next, the fourth embodiment of the present invention will be described with reference to FIGS. 15 and 16. The attachment 10 of the present embodiment is mounted on a carriage 130 for mounting an ink cartridge 101, in place of the ink cartridge 101 which is disclosed as the second embodiment in EP1424202. In order to be mountable on the carriage 130, an outer structure of the attachment 10 is the same as that of the ink cartridge 101 disclosed in EP1424202. The outer structures of the ink cartridge 101 and the carriage 130 for mounting the ink cartridge 101 are discussed in detail in EP1424202, the disclosure of which is incorporated herein by reference in its entity.

In the present embodiment, the porous body 142 is disposed inside the attachment 10 the same as in the third embodiment, for a simple configuration. In addition, the connection portion 17 projects into the attachment 10 to compress the A portion of the porous body 142, similarly to the third embodiment. The ink outlet portion 19 also projects into the attachment 10 to compress the B portion of the porous body 142. A compressibility of the porous body 142 in the B portion is higher than that of the porous body 142 in the A portion, so that a capillary force of the porous body 142 in the B portion is higher than that of the porous body 142 in the A portion.

Figure 16:
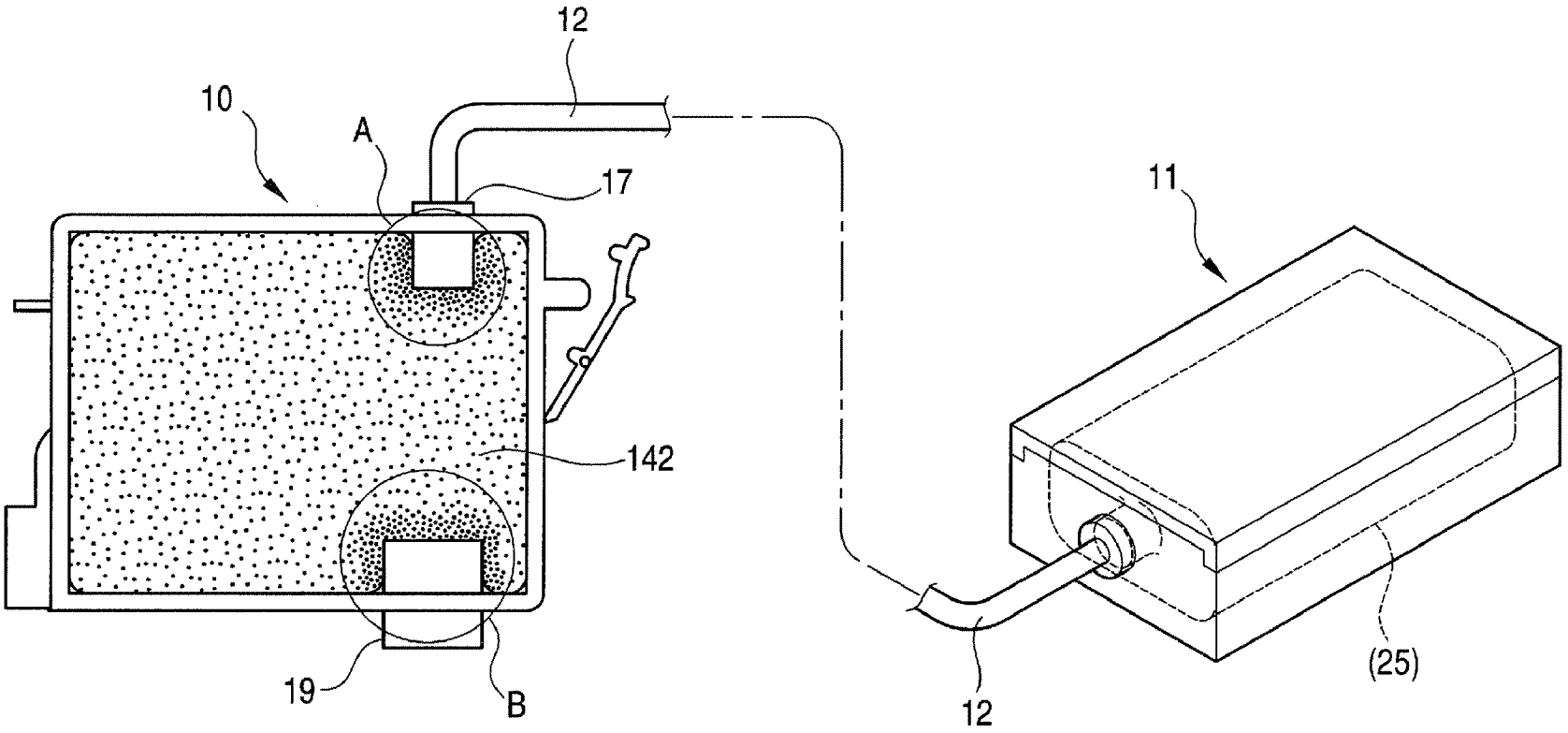
FIG. 16 is a schematic view illustrating an attachment system in the fourth embodiment.

Although various structures of the outer ink tank 11 can be used as described above, an example of an ink pack 25 disclosed in EP1454754 is schematically shown in FIG. 16. The ink pack 25 is mounted in a case, which is composed of a lid and a case body, so as to be removable for the convenience of installation and replacement.

Further, instead of the porous body 142, the valve device of the first and the second embodiments may be provided inside the attachment 10, or an ink path and a valve device disclosed in EP1398156 may be provided inside the attachment 10.

The same advantage as that of the third embodiment can be obtained, also in the present embodiment.

Each of the above-described embodiments uses the outer ink tank 11 with a large capacity, so that the attachment system is exposed outside for a long time. Accordingly, it is preferable that the attachment system be given a gas barrier characteristics, in order to prevent any variation of a characteristic or a deaeration degree of ink.

For example, in order to give a good gas barrier characteristics to the attachment 10, the unit case 15 of the attachment 10 is preferably formed of polypropylene (PP), polyethylene (PE), liquid crystal polymer, or the like.

For example, in order to give a good gas barrier characteristics to the ink supply tube 12, the ink supply tube 12 is preferably formed of nylon, vinylidene chloride or the like, or formed to have a multi-layered structure having a layer or layers formed of nylon, vinylidene chloride or the like.

For example, in order to give a good gas barrier characteristics to the outer ink tank 11, so-called a bag-shaped ink pack may be used, which is disclosed in JP2004-249511 or EP1454754. As a film forming the ink pack, for example, a polyethylene film may be used, of which the surface is laminated by aluminum foil.

Although all of the attachment 10, the ink supply tube 12, and the outer ink tank 11 may be given a high gas barrier characteristics, at least one of them may be given a high gas barrier characteristics, so that a relative gas barrier characteristics can be heightened in the entire attachment system.

Further, the above embodiment may be modified as below.

Although the storage means 21 is provided in the attachment 10 in each of the above-described embodiments, the storage means 21 may be provided in the outer ink tank 11.

In each of the above described present embodiments, although an ink-jetting printer (printing device including a facsimile, a copier, and the like) as a liquid jet device has been described, the ink jetting printer can be applied to a liquid jet device which jets other kinds of liquid. For example, the present embodiment can be applied to a liquid jet device which jets such liquid as an electrode material or a color material used for manufacturing a liquid crystal display, an EL display, and a surface emitting display. The present embodiment can also be applied to a liquid jet device which jets a living organic material used for manufacturing a biotip, and a sample jet device as a precision pipette.

What is claimed is:

1. An ink supply system for supplying ink to the print head of a printing portion of a printing apparatus, the ink supply system comprising:

a case having an opening and defining an ink pack storage enclosure, wherein the printing portion is outside of the case;

a lid that covers the opening;

an ink supply tube coupled to the case and adapted to supply ink from within the ink pack storage enclosure to the print head;

the case having an ink pack attachment portion in fluid communication with the ink supply tube;

a flexible ink pack removably attached to the ink pack attachment portion within the case, and installable and removable when the lid is opened, such that access to the ink pack storage enclosure is blocked when the lid is closed; and a storage device, containing information about the ink in the ink pack apart from and electronically connected to the printing portion, wherein the flexible ink pack includes:

an outlet portion; and a bag portion formed by a first film and a second film facing the first film, an axis line passing through a center of the outlet portion being disposed between the first film and the second film, wherein the first film is close to the case, and the second film is closer to the lid than the first film.

2. The ink supply system according to claim 1, wherein the first film includes a first face extending in a direction parallel to the axis line, the second film includes a second face extending in a direction parallel to the axis line, the first face is close to the case, and the second face is closer to the lid than the first face.

* * * * *